US011158279B2

(12) United States Patent
Lee et al.

(10) Patent No.: US 11,158,279 B2
(45) Date of Patent: Oct. 26, 2021

(54) DISPLAY APPARATUS AND CONTROLLING METHOD THEREOF

(71) Applicant: SAMSUNG ELECTRONICS CO., LTD., Suwon-si (KR)

(72) Inventors: Jae Moon Lee, Yongin-si (KR); Min Hoon Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/765,094

(22) PCT Filed: Sep. 3, 2018

(86) PCT No.: PCT/KR2018/010226
§ 371 (c)(1),
(2) Date: May 18, 2020

(87) PCT Pub. No.: WO2019/098513
PCT Pub. Date: May 23, 2019

(65) Prior Publication Data

US 2020/0357353 A1 Nov. 12, 2020

(30) Foreign Application Priority Data

Nov. 16, 2017 (KR) ..... 10-2017-0152890

(51) Int. Cl.
*G09G 3/36* (2006.01)

(52) U.S. Cl.
CPC ..... *G09G 3/3688* (2013.01); *G09G 2310/08* (2013.01); *G09G 2320/0209* (2013.01); *G09G 2320/0285* (2013.01); *G09G 2340/10* (2013.01)

(58) Field of Classification Search
CPC ... G09G 2300/0876; G09G 2320/0209; G09G 2320/0276; G09G 2320/043;
(Continued)

(56) References Cited

U.S. PATENT DOCUMENTS

2007/0262940 A1* 11/2007 Morimoto ..... G09G 3/3648 345/94
2011/0109662 A1* 5/2011 Cho ..... G09G 3/3688 345/690
(Continued)

FOREIGN PATENT DOCUMENTS

KR 10-1213945 12/2012
KR 10-2014-0041325 4/2014
(Continued)

OTHER PUBLICATIONS

International Search Report for PCT/KR2018/010226 dated Jan. 4, 2019, 5 pages.
(Continued)

*Primary Examiner* — Dong Hui Liang
(74) *Attorney, Agent, or Firm* — Nixon & Vanderhye, P.C.

(57) ABSTRACT

A display apparatus includes a display panel including a plurality of pixels; a source driver configured to convert RGB image data into an RGB image signal, and output the RGB image signal based on a common voltage to each of the plurality of pixels; and a timing controller configured to output the RGB image data to the source driver, and when it is determined the common voltage is changed, the timing controller may adjust the RGB image data to compensate the change of the common voltage, and output the adjusted RGB image data to the source driver.

13 Claims, 19 Drawing Sheets

(58) Field of Classification Search
CPC ... G09G 2320/0233; G09G 2320/0242; G09G 2320/0223; G09G 2320/103; G09G 2320/0285; G09G 2320/02; G09G 2320/0214; G09G 2310/06; G09G 2310/027; G09G 2310/0254; G09G 2310/0256; G09G 2310/0262; G09G 3/3614; G09G 3/3648; G09G 3/3655; G09G 3/3688; G09G 3/3696; G09G 3/36; G09G 3/3659
See application file for complete search history.

(56) References Cited

U.S. PATENT DOCUMENTS

2013/0147861 A1* 6/2013 Kim ..... G09G 5/10 345/690
2015/0187291 A1* 7/2015 Jang ..... G09G 3/3655 345/694
2016/0343326 A1* 11/2016 Li ..... G09G 3/3611

FOREIGN PATENT DOCUMENTS

KR 10-1507152 4/2015
KR 10-2015-0059525 6/2015
KR 10-2015-0079259 7/2015

OTHER PUBLICATIONS

Written Opinion of the ISA for PCT/KR2018/010226 dated Jan. 4, 2019, 5 pages.

* cited by examiner

DISPLAY APPARATUS AND CONTROLLING METHOD THEREOF

This application is the U.S. national phase of International Application No. PCT/KR2018/010226 filed Sep. 3, 2018 which designated the U.S. and claims priority to Korean Patent Application No. 10-2017-0152890 filed Nov. 16, 2017, the entire contents of each of which are hereby incorporated by reference.

TECHNICAL FIELD

Embodiments of the disclosure relate to a display apparatus and a controlling method thereof, more specifically to a display apparatus and a controlling method for improving crosstalk of a liquid crystal display.

BACKGROUND ART

In general, a display apparatus is an output device that visually displays received or stored image information to a user, and is used in various home-based or business fields.

For example, as a display apparatus, a monitor device connected to a personal computer or a server computer, a portable computer device, a navigation terminal device, a general television device, an Internet Protocol television (IPTV) device, a smartphone, a portable terminal device such as a tablet PC, a personal digital assistant (PDA), or a cellular phone, various display devices are used to play images such as advertisements or movies in an industrial field, or various other types of audio/video systems.

A display panel includes pixels arranged in a matrix form and thin film transistors (TFTs) provided on each of the pixels, and transmits or emits each of the pixels according to an image signal applied to the thin film transistor to be able to change the amount of light. The display apparatus can display an image by adjusting the amount of light emitted from each of the pixels of the display panel.

On the other hand, when an image of a specific pattern is displayed on the display panel, visual coupling may occur in the image displayed on the display panel due to interference between pixels. Such visual coupling due to interference between pixels is referred to as crosstalk (hereinafter referred to as 'crosstalk') of the display apparatus.

SUMMARY

One aspect provides a display apparatus and a control method thereof capable of improving crosstalk of a display panel.

In accordance with an aspect of the disclosure, a display apparatus comprises a display panel including a plurality of pixels; a source driver configured to convert RGB image data into an RGB image signal, and output the RGB image signal based on a common voltage to each of the plurality of pixels; and a timing controller configured to output the RGB image data to the source driver, and when it is determined the common voltage is changed, the timing controller may adjust the RGB image data to compensate the change of the common voltage, and output the adjusted RGB image data to the source driver.

The timing controller may change the RGB image data into any one of first RGB image data or second RGB image data according to positions of the plurality of pixels by using a first lookup table and a second lookup table. The source driver may output any one of a normal RGB image signal or an inverted RGB image signal based on the common voltage according to the positions of the plurality of pixels.

The timing controller may alternately change the RGB image data to the first RGB image data and the second RGB image data by alternately using the first lookup table and the second lookup table according to the positions of the plurality of pixels. The source driver may alternately output the normal RGB image signal and the inverted RGB image signal according to the positions of the plurality of pixels.

The timing controller may synthesize the RGB image data and any one of the first and second RGB image data, and outputs the synthesized image data to the source driver.

The timing controller may add any one of the first and second RGB image data to which a first weight is applied and the RGB image data to which a second weight is applied, and may output the added RGB image data to the source driver.

The timing controller may determine a normal voltage value of the RGB image signal from the RGB image data; determine an inverted voltage value of the RGB image signal from the RGB image data; determine a voltage value of the normal RGB image signal from any one of the first RGB image data and the second RGB image data; determine a voltage value of the inverted RGB image signal from any one of the first RGB image data and the second RGB image data; and set a first and second weight so that a sum of the voltage value of the normal RGB image signal to which the first weight is applied and the voltage value of the normal RGB image signal to which the second weight is applied is equal to a sum of the voltage value of the inverted RGB image signal to which the first weight is applied and the voltage value of the inverted RGB image signal to which the second weight is applied.

The timing controller may determine the RGB image signal from the RGB image data, determine a change amount of the common voltage, change the RGB image signal according to the change amount of the common voltage, and output the RGB image data corresponding to the changed RGB image signal to the source driver.

The timing controller may change the RGB image signal larger than a reference voltage according to the change amount of the common voltage.

In accordance with an aspect of the disclosure, a control method of a display apparatus may comprise: acquiring RGB image data; converting the RGB image data into an RGB image signal; and outputting the RGB image signal based on a common voltage to each of the plurality of pixels; and when it is determined the common voltage is changed, the method may further comprise adjusting the RGB image data to compensate the change of the common voltage.

The method may further include: changing the RGB image data into any one of first RGB image data or second RGB image data according to positions of the plurality of pixels by using a first lookup table and a second lookup table; and outputting any one of a normal RGB image signal or an inverted RGB image signal based on the common voltage according to the positions of the plurality of pixels.

The changing the RGB image data into any one of the first RGB image data or the second RGB image data may include alternately changing the RGB image data to the first RGB image data and the second RGB image data by alternately using the first lookup table and the second lookup table according to the positions of the plurality of pixels, and the outputting any one of the normal RGB image signal or the inverted RGB image signal may include alternately outputting the normal RGB image signal and the inverted RGB image signal according to the positions of the plurality of pixels.

The adjusting the RGB image data to compensate the change of the common voltage may include synthesizing the RGB image data and any one of the first and second RGB image data.

Synthesizing the RGB image data and any one of the first and second RGB image data may include adding any one of the first and second RGB image data to which a first weight is applied and the RGB image data to which a second weight is applied The method may further include determining a normal voltage value of the RGB image signal from the RGB image data; determining an inverted voltage value of the RGB image signal from the RGB image data; determining a voltage value of the normal RGB image signal from any one of the first RGB image data and the second RGB image data; determining a voltage value of the inverted RGB image signal from any one of the first RGB image data and the second RGB image data; and setting a first and second weight so that a sum of the voltage value of the normal RGB image signal to which the first weight is applied and the voltage value of the normal RGB image signal to which the second weight is applied is equal to a sum of the voltage value of the inverted RGB image signal to which the first weight is applied and the voltage value of the inverted RGB image signal to which the second weight is applied.

The adjusting the RGB image data to compensate the change of the common voltage may include determining the RGB image signal from the RGB image data, determining a change amount of the common voltage, changing the RGB image signal according to the change amount of the common voltage, and adjusting the RGB image data based on the changed RGB image signal.

The changing of the RGB image signal according to the change amount of the common voltage may include changing the RGB image signal larger than a reference voltage according to the change amount of the common voltage.

In accordance with an aspect of the disclosure, a display apparatus comprises a display panel including a plurality of pixels; a source driver configured to convert RGB image data into an RGB image signal, and output the RGB image signal based on a common voltage to each of the plurality of pixels; and a timing controller configured to output the RGB image data to the source driver; and a controller configured to generate the RGB image data from content data, and when it is determined the common voltage is changed, the controller may adjust the RGB image data to compensate the change of the common voltage, and output the adjusted RGB image data to the timing controller.

The controller may change the RGB image data into any one of first RGB image data or second RGB image data according to positions of the plurality of pixels by using a first lookup table and a second lookup table, and synthesize any one of the first and second RGB image data and the RGB image data, and outputs the synthesized RGB image data to the timing controller.

The controller may change the RGB image data into any one of the first RGB image data or the second RGB image data by using the first lookup table and the second lookup table according to the positions of the plurality of pixels. The controller may add any one of the first and second RGB image data to which a first weight is applied and the RGB image data to which a second weight is applied, and output the added RGB image data to the source driver.

The controller may determine the RGB image signal from the RGB image data, determine a change amount of the common voltage, change the RGB image signal according to the change amount of the common voltage, and output the RGB image data corresponding to the changed RGB image signal to the timing controller.

According to a display apparatus and a control method thereof, it is possible to improve crosstalk of a display panel using image processing software without structural changes of the display panel.

BRIEF DESCRIPTION OF THE DRAWINGS

FIG. 17 illustrates a modification of a mapping graph for reducing crosstalk shown in

FIG. 13.

DETAILED DESCRIPTION OF EXAMPLE EMBODIMENTS

Figure 1:
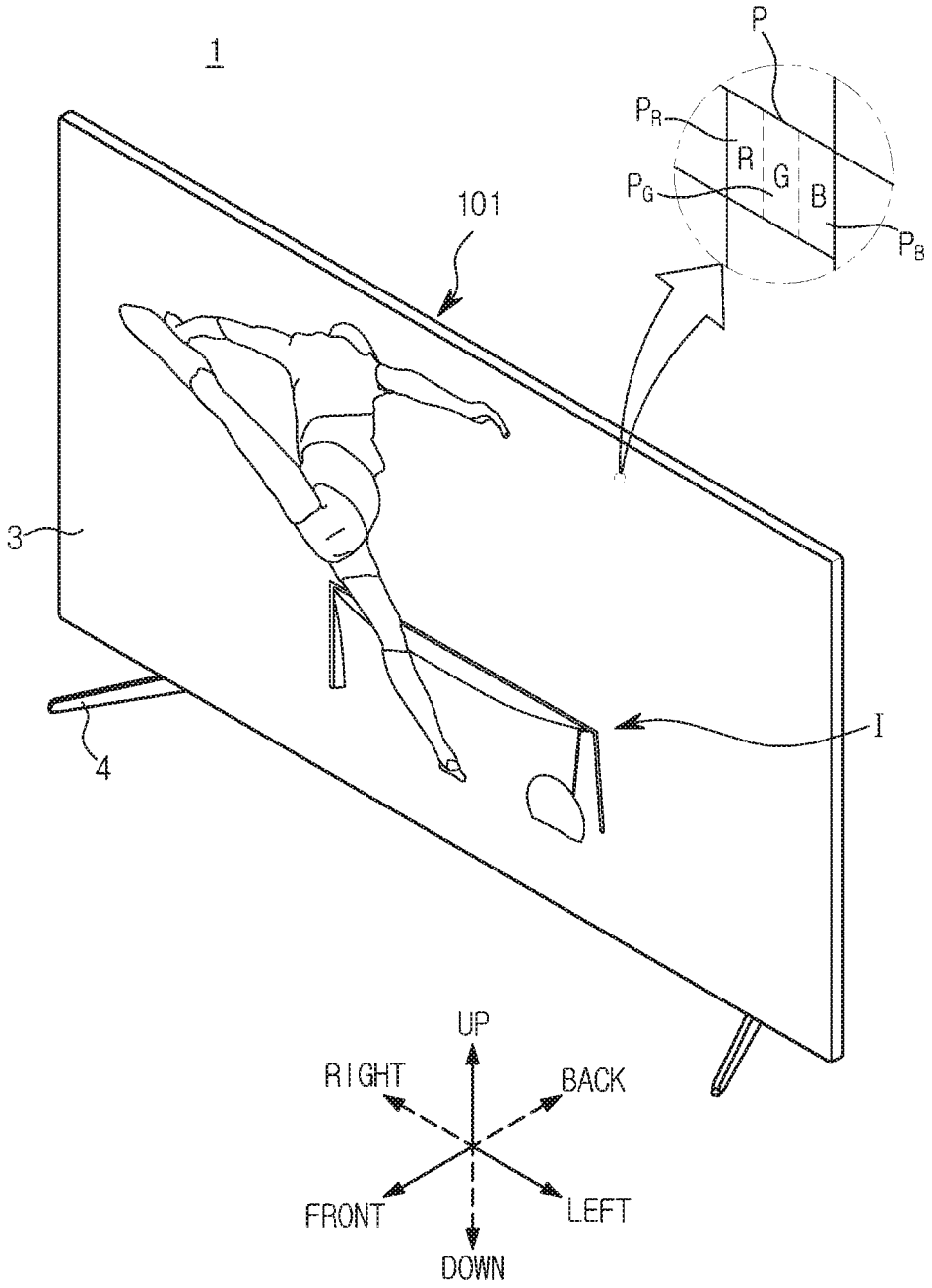
FIG. 1 is a view illustrating an appearance of a display apparatus according to an embodiment of the present disclosure.

In the following description, like reference numerals refer to like elements throughout the specification. This specification does not describe all elements of the embodiments, and in the technical field to which the present invention pertains, there is no overlap between the general contents or the embodiments. Terms such as "unit," "module," "member," and "block" may be embodied as hardware or software. According to embodiments, a plurality of "units," "modules," "members," or "blocks" may be implemented as a single component or a single "unit," "module," "member," or "block" may include a plurality of components.

In all specifications, it will be understood that when an element is referred to as being "connected" to another element, it can be directly or indirectly connected to the other element, wherein the indirect connection includes "connection via a wireless communication network."

Also, when a part "includes" or "comprises" an element, unless there is a particular description contrary thereto, the part may further include other elements, not excluding the other elements.

Throughout the specification, when one member is positioned "on" another member, this includes not only the case where one member abuts another member, but also the case where another member exists between the two members.

The terms first, second, etc. are used to distinguish one component from another component, and the component is not limited by the terms described above.

An expression used in the singular form encompasses the expression of the plural form, unless it has a clearly different meaning in the context.

The reference numerals used in operations are used for descriptive convenience and are not intended to describe the order of operations and the operations may be performed in an order different unless otherwise stated.

Hereinafter, embodiments of the present disclosure will be described with reference to the accompanying drawings.

FIG. 1 is a view illustrating an appearance of a display apparatus according to an embodiment of the present disclosure.

A display apparatus 1 is a device capable of processing an image signal received from the outside and visually displaying the processed image. Hereinafter, the case where the display apparatus 1 is a television (Television, TV) is illustrated, but is not limited thereto. For example, the display apparatus 1 may be implemented in various forms such as a monitor, a portable multimedia device, a portable communication device, and a portable computing device. If the display apparatus 1 is a device that visually displays an image, its form is not limited.

In addition, the display apparatus 1 may be a large display apparatus (Large Format Display, LFD) installed outdoors, such as a roof of a building or a bus stop. Here, the outdoors is not necessarily limited to the outdoors, and the display apparatus 1 according to an embodiment may be installed in a subway station, a shopping mall, a movie-theater, a company, a shop, etc., wherever a large number of people can enter or exit.

The display apparatus 1 may receive a video signal and an audio signal from various content sources, and output video and audio corresponding to the video signal and the audio signal. For example, the display apparatus 1 may receive television broadcast content through a broadcast receiving antenna or a wired cable, receive content from a content playback device, or receive content from a content providing server of a content provider.

As shown in FIG. 1, the display apparatus 1 includes a main body 2 accommodating a plurality of parts for displaying an image, and a screen 3 provided on one side of the main body 2 to display an image I.

The main body 2 forms an external shape of the display apparatus 1, and a component for the display apparatus 1 to display the image I may be provided inside the main body 2. The main body 2 shown in FIG. 1 is a flat plate shape, but the shape of the main body 2 is not limited to that shown in FIG. 1. For example, the main body 2 may be curved such that both right and left ends protrude forward and the center is concave.

The screen 3 is formed on the front surface of the main body 2, and the image I as visual information may be displayed on the screen 3. For example, a still image or a video may be displayed on the screen 3, and a 2D flat image or a 3D stereoscopic image may be displayed.

A plurality of pixels P are formed on the screen 3, and the image I displayed on the screen 3 may be formed by a combination of light emitted from the plurality of pixels P. For example, the light emitted by the plurality of pixels P may be combined as a mosaic to form the single image I on the screen 3.

Each of the plurality of pixels P may emit light of various brightness and various colors.

In order to emit light of various brightness, each of the plurality of pixels P may include a configuration (for example, an organic light emitting diode) capable of directly emitting light, or include a configuration (for example, a liquid crystal panel) capable of transmitting or blocking light emitted by a backlight unit or the like.

In order to emit light of various colors, each of the plurality of pixels P may include sub-pixels $P_R$, $P_G$, and $P_B$.

The sub-pixels $P_R$, $P_G$, and $P_B$ include the red sub-pixel $P_R$ that can emit red light, the green sub-pixel $P_G$ that can emit green light, and the blue sub-pixel $P_B$ that can emit blue light. For example, the red light may represent light at a wavelength of approximately 620 nm (nanometer, 1 billionth of a meter) to 750 nm, the green light may represent light at a wavelength of approximately 495 nm to 570 nm, and the blue light may represent light from approximately 450 nm to 495 nm.

By combining the red light of the red sub-pixel $P_R$, the green light of the green sub-pixel $P_G$ and the blue light of the blue sub-pixel $P_B$, each of the plurality of pixels P emits light of various brightness and various colors.

The screen 3 shown in FIG. 1 is a flat plate shape, but the shape of the screen 3 is not limited to that shown in FIG. 1. For example, depending on the shape of the main body 2, the screen 3 may have a shape in which both right and left ends protrude forward and the center portion is concave.

Hereinafter, a display apparatus including a liquid crystal display panel (LCD Panel) is described as an example of the display apparatus 1, however the display apparatus 1 is not limited to the display apparatus including the liquid crystal display panel, and the display apparatus 1 may include a light emitting diode panel (LED panel) or an organic light emitting diode panel (OLED panel).

Figure 2:
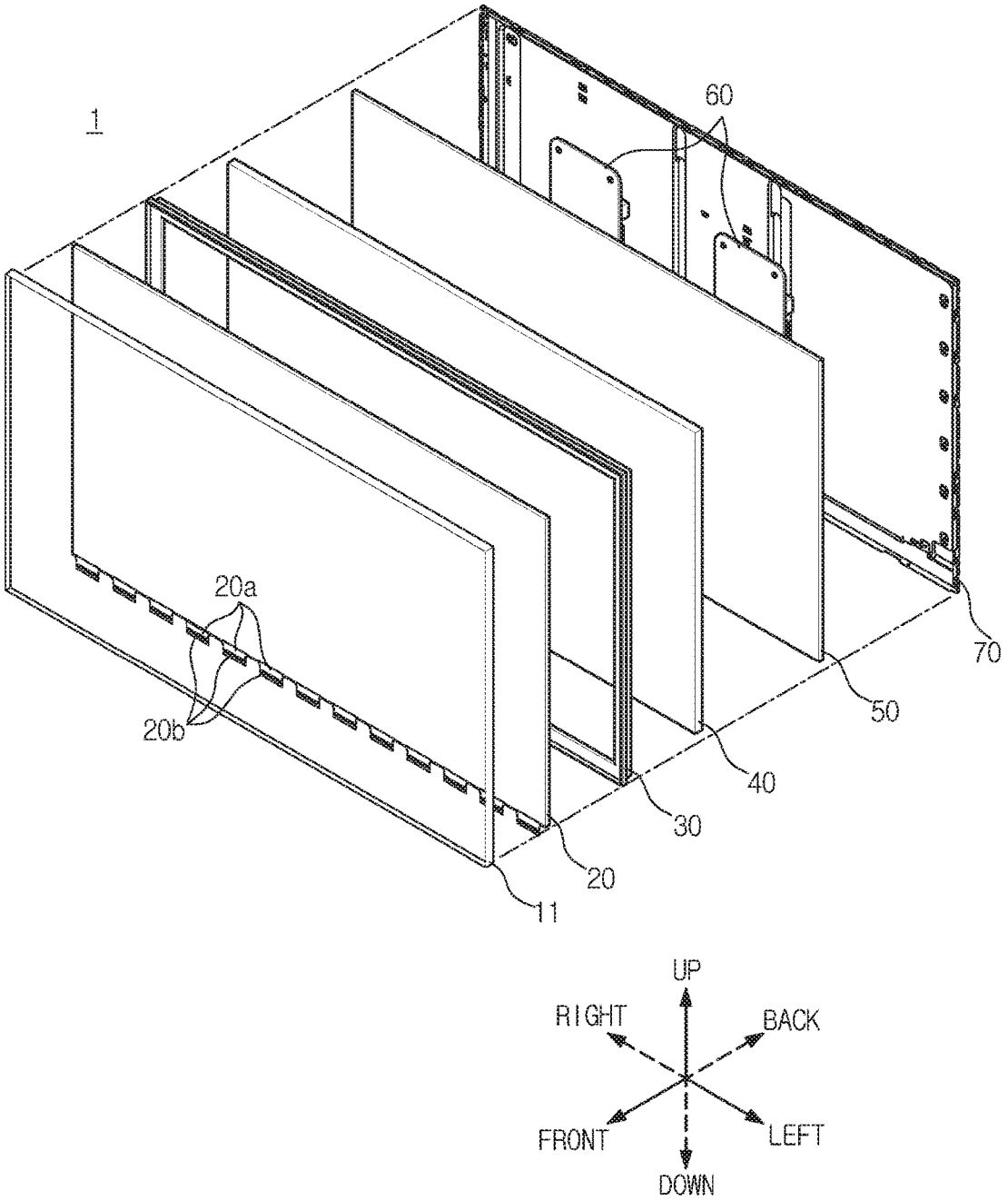
FIG. 2 is an exploded view of a display apparatus according to an embodiment.
Figure 3:
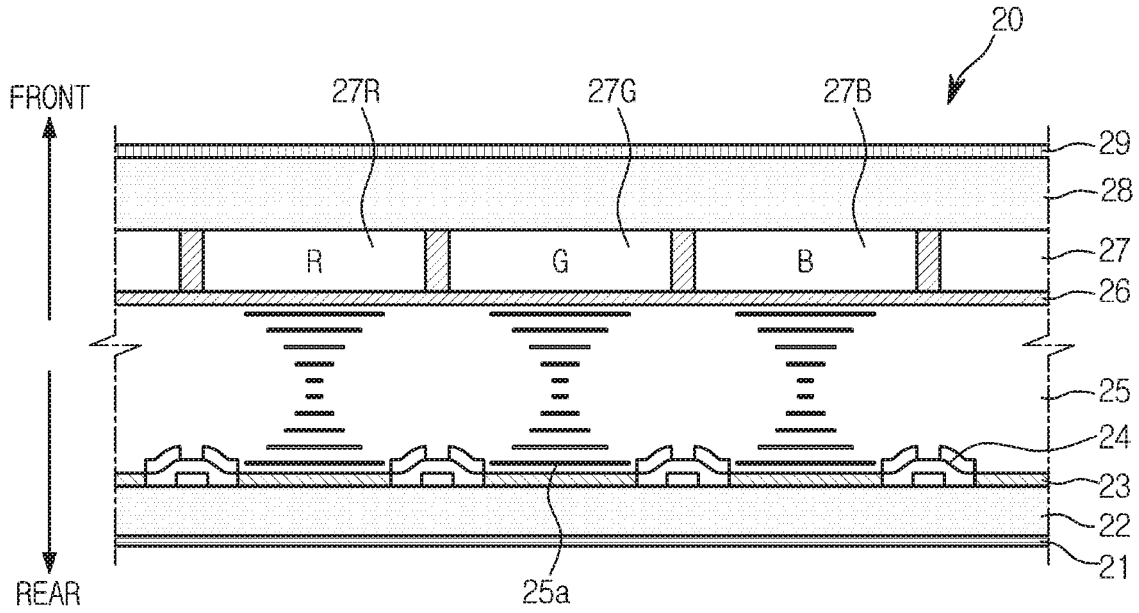
FIG. 3 is a view illustrating an example of a liquid crystal panel included in a display apparatus according to an embodiment.

FIG. 2 is an exploded view of a display apparatus according to an embodiment. FIG. 3 is a view illustrating an example of a liquid crystal panel included in a display apparatus according to an embodiment.

As illustrated in FIG. 2, various component parts for generating the image I on the screen 3 may be provided inside the main body 2.

For example, the main body 2 includes a backlight unit 40 that emits surface light forward, a liquid crystal panel 20 that blocks or transmits light emitted from the backlight unit 40, and a power supply/control unit 60 for controlling the operation of the backlight unit 40 and the liquid crystal panel 20 are provided. In addition, the main body 2 has a bezel 10 for supporting and fixing the liquid crystal panel 20, the backlight unit 40, and the power supply/control unit 60, and a frame middle mold 30, a bottom chassis 50 and a rear cover 70 is further provided.

The backlight unit 40 may include a point light source that emits monochromatic light or white light, and may refract, reflect, and scatter light to convert light emitted from the point light source into uniform surface light.

For example, the backlight unit 40 includes a light source that emits monochromatic light or white light, a light guide plate through which light is incident and diffuses the incident light from the light source, a reflective sheet that reflects the light emitted from the back of the light guide plate, and an optical sheet that refracts and scatters the light emitted from the front surface of the light guide plate.

As such, the backlight unit 40 may emit uniform surface light toward the front by refracting, reflecting, and scattering the light emitted from the light source.

The liquid crystal panel 20 is provided in front of the backlight unit 40 and blocks or transmits light emitted from the backlight unit 40 to form the image I.

The front surface of the liquid crystal panel 20 forms the screen 3 of the display apparatus 1 described above, and may be composed of the plurality of pixels P. The plurality of pixels P included in the liquid crystal panel 20 may independently block or transmit light from the backlight unit 40, and the light transmitted by the plurality of pixels P may form the image I displayed on the display apparatus 1.

For example, as illustrated in FIG. 3, the liquid crystal panel 20 includes a first polarizing film 21, a first transparent substrate 22, a pixel electrode 23, a thin film transistor 24, a liquid crystal layer 25, a common electrode 26, a color filter 27, a second transparent substrate 28, and a second polarizing film 29.

The first transparent substrate 22 and the second transparent substrate 28 may fix the pixel electrode 23, the thin film transistor 24, the liquid crystal layer 25, the common electrode 26, and the color filter 27. The first and second transparent substrates 22 and 28 may be made of tempered glass or transparent resin.

The first polarizing film 21 and the second polarizing film 29 are provided outside the first and second transparent substrates 22 and 28.

The first polarizing film 21 and the second polarizing film 29 may respectively transmit specific light and block other light.

The light may consist of a pair of electric and magnetic fields that vibrate in a direction orthogonal to a traveling direction. The electric and magnetic fields constituting the light can vibrate in all directions orthogonal to the traveling direction of light, and the direction of vibration of the electric field and the direction of vibration of the magnetic field may be orthogonal to each other.

For example, the first polarizing film 21 transmits light having a magnetic field vibrating in a first direction, and blocks other light. In addition, the second polarizing film 29 transmits light having a magnetic field vibrating in a second direction, and blocks other light. At this time, the first direction and the second direction may be orthogonal to each other. In other words, a polarization direction of light transmitted by the first polarizing film 21 and a vibration direction of light transmitted by the second polarizing film 29 are orthogonal to each other. As a result, in general, light cannot pass through the first polarizing film 21 and the second polarizing film 29 at the same time.

The color filter 27 may be provided inside the second transparent substrate 28.

The color filter 27 may include a red filter 27R that transmits red light, a green filter 27G that transmits green light, and a blue filter 27B that transmits blue light, and the red filter 27R, the green filter 27G, and the blue filter 27B may be arranged side by side.

The area where the color filter 27 is formed corresponds to the pixel P described above. In addition, the region where the red filter 27R is formed corresponds to the red sub-pixel $P_R$, the region where the green filter 27G is formed corresponds to the green sub-pixel $P_G$, and the region where the blue filter 27B is formed corresponds to the blue sub-pixel $P_B$.

The thin film transistor (TFT) 24 is provided inside the first transparent substrate 22. For example, the thin film transistor 24 may be provided at a position corresponding to a boundary between the red filter 27R, the green filter 27G, and the blue filter 27B.

The thin film transistor 24 may pass or block current flowing through the pixel electrode 23 to be described below. For example, an electric field may be formed or removed between the pixel electrode 23 and the common electrode 26 according to turn-on (closed) or turn-off (opening) of the thin film transistor 24.

The thin film transistor 24 may be made of poly-silicon, and may be formed by semiconductor processes such as lithography, deposition, and ion implantation.

The pixel electrode 23 may be provided inside the first transparent substrate 22, and the common electrode 26 may be provided inside the second transparent substrate 28.

The pixel electrode 23 and the common electrode 26 are made of a metal material that conducts electricity, and can generate an electric field for changing the arrangement of liquid crystal molecules 25*a* constituting the liquid crystal layer 25 described below.

The pixel electrode 23 is formed separately in regions corresponding to the red filter 27R, the green filter 27G, and the blue filter 27B, and the common electrode 26 extends from one side of the liquid crystal panel 20 to the other side. In other words, a plurality of the pixel electrodes 23 disposed in the same row may share the one common electrode 26. As a result, an electric field may be selectively formed in the liquid crystal layer 25 according to the position of the pixel electrode 23.

The pixel electrode 23 and the common electrode 26 are made of a transparent material and can transmit light incident from the outside. For example, the pixel electrode 23 and the common electrode 26 may be configured by indium tin oxide (ITO), indium zinc oxide (IZO), silver nanowire, Ag nano wire, carbon nanotube (CNT), graphene or PEDOT (3,4-ethylenedioxythiophene).

The liquid crystal layer 25 is formed between the pixel electrode 23 and the common electrode 26, and the liquid crystal layer 25 is filled by the liquid crystal molecules 25*a*.

Liquid crystals show an intermediate state between a solid (crystal) and a liquid. In general materials, when heat is applied to a solid material, a state change occurs at the melting temperature from a solid state to a transparent liquid state. On the other hand, when heat is applied to the liquid crystal material in the solid state, the liquid crystal material changes to an opaque and cloudy liquid at the melting temperature and then to a transparent liquid state. Most of these liquid crystal materials are organic compounds, and the molecular shape has an elongated rod shape, and the arrangement of molecules is the same as an irregular state in one direction, but in other directions, it may have a regular crystal form. As a result, the liquid crystal has both the fluidity of liquid and the optical anisotropy of crystal (solid).

In addition, liquid crystals may exhibit optical properties according to changes in an electric field. For example, the direction of the molecular arrangement constituting the liquid crystal may change according to a change in the electric field of the liquid crystal.

When an electric field is generated in the liquid crystal layer 25, the liquid crystal molecules 25*a* of the liquid crystal layer 25 are arranged according to the direction of the electric field, and when an electric field is not generated in the liquid crystal layer 25, the liquid crystal molecules 25*a* may be irregularly arranged or may be disposed along an alignment layer (not shown).

As a result, the optical properties of the liquid crystal layer 25 may vary according to the presence or absence of an electric field passing through the liquid crystal layer 25.

For example, in the case of a TN (Twisted Nematic) liquid crystal panel, the liquid crystal molecules 25*a* are arranged in a spiral shape, and when an electric field is not formed in the liquid crystal layer 25, light may pass through the liquid crystal panel 20 due to the arrangement of the liquid crystal molecules 25*a* of the liquid crystal layer 25. On the other hand, when an electric field is formed in the liquid crystal layer 25, the liquid crystal molecules 25*a* are disposed perpendicular to the transparent substrates 22 and 28, and light does not pass through the liquid crystal panel 20.

As another example, in the case of a VA (Vertical Alignment) liquid crystal panel, the liquid crystal molecules 25*a* are vertically disposed with the transparent substrates 22 and 28, and when an electric field is not formed in the liquid crystal layer 25, light cannot pass through the liquid crystal panel 20 due to the arrangement of the liquid crystal molecules 25*a* of the liquid crystal layer 25. In addition, when an electric field is formed in the liquid crystal layer 25, the liquid crystal molecules 25*a* are disposed in parallel with the transparent substrates 22 and 28, and light may pass through the liquid crystal panel 20.

As another example, in the case of an IPS (In-Plane-Switching) liquid crystal panel, the liquid crystal molecules 25*a* may be horizontally disposed with the transparent substrates 22 and 28. For IPS liquid crystal display, both the pixel electrode 23 and the common electrode 26 are provided on the first transparent substrate 22, and an electric field in a direction parallel to the transparent substrates 22 and 28 may be formed on the liquid crystal layer 25. Depending on whether an electric field is formed on the liquid crystal side 25, light may pass through the liquid crystal panel 20 or be blocked by the liquid crystal panel 20.

The power supply/control unit 60 may include a power supply circuit that supplies power to the backlight unit 40 and the liquid crystal panel 20 and a control circuit that controls the operation of the backlight unit 40 and the liquid crystal panel 20.

The power supply circuit supplies power to the backlight unit 40 so that the backlight unit 40 can emit surface light, and supplies power to the liquid crystal panel 20 so that the liquid crystal panel 20 may transmit or block light.

The control circuit may control the backlight unit 40 to control the intensity of light emitted by the backlight unit 40, and may control the liquid crystal panel 20 to display an image on the screen 3.

For example, the control circuit may control the liquid crystal panel 20 to display an image based on a video signal received from content sources. Each of the plurality of pixels P included in the liquid crystal panel 20 transmits or blocks light according to the image data of the control circuit, and as a result, the image I is displayed on the screen 3.

The power supply/control unit 60 may be implemented with a printed circuit board and various circuits mounted on the printed circuit board. For example, the power supply circuit may include a capacitor, a coil, a resistance element, a microprocessor, and the like, and a power supply circuit board on which they are mounted. Further, the control circuit may include a memory, a microprocessor, and a control circuit board on which they are mounted.

Between the liquid crystal panel 20 and the power supply/control unit 60, a cable 20*a* for transmitting image data from the power supply/control unit 60 to the liquid crystal panel 20, and a display driver integrated circuit for processing the image data (Display Driver Integrated Circuit, DDI) 20*b* (hereinafter referred to as 'display drive unit') is provided.

The cable 20*a* may electrically connect the power supply/control unit 60 and the display drive unit 20*b*, and electrically connect the display drive unit 20*b* and the liquid crystal panel 20.

The display drive unit 20*b* may receive image data from the power supply/control unit 60 through the cable 20*a* and transmit the image data to the liquid crystal panel 20 through the cable 20*a*.

The cable 20*a* and the display drive unit 20*b* may be embodied as a film cable, a chip on film (COF), or a tape carrier packet (TCP). In other words, the display drive unit 20*b* may be disposed on the cable 20*a*.

However, the present invention is not limited thereto, and the display drive unit 20*b* may be disposed on the first transparent substrate 22 of the liquid crystal panel 20.

Figure 4:
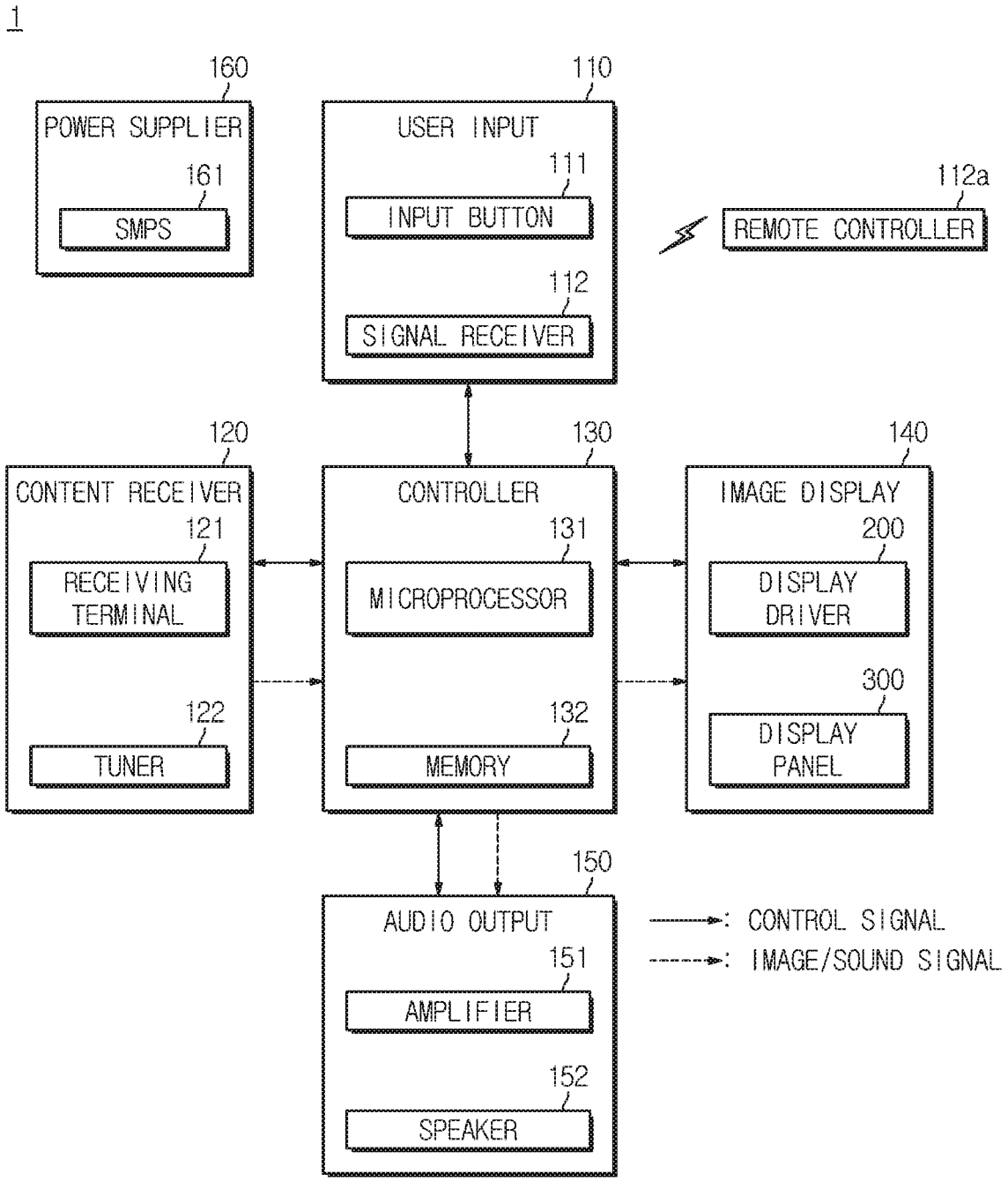
FIG. 4 is a view illustrating a configuration of a display apparatus according to an embodiment.

FIG. 4 is a view illustrating a configuration of a display apparatus according to an embodiment.

As shown in FIG. 4, the display apparatus 1 includes a user input 110 for receiving user input from a user, a content receiver 120 for receiving video signals and/or audio signals from content sources, a controller 130 that processes the video signal and/or audio signal received by the content receiver 120 and controls the operation of the display apparatus 1, an image display 140 for displaying the image processed by the controller 130, an audio output 150 for outputting the sound processed by the controller 130, and a power supplier 160 for supplying power to the components of the display apparatus 1.

The user input 110 may include an input button 111 for receiving the user input. For example, the user input 110 may include a power button for turning on or off the display apparatus 1, a channel selection button for selecting broadcast content displayed on the display apparatus 1, a sound control button for adjusting a volume of the sound output from the display apparatus 1, and a source selection button for selecting a content source.

Each of the input buttons 111 may receive the user input and output an electrical signal corresponding to the user input to the controller 130, and can be implemented by various input means such as a push switch, a touch switch, a dial, a slide switch, and a toggle switch.

The user input 110 also includes a signal receiver 112 that receives a remote control signal from a remote controller 112*a*. The remote controller 112*a* receiving the user input may be provided separately from the display apparatus 1, and may receive the user input and transmit a wireless signal corresponding to the user input to the display apparatus 1. The signal receiver 112 may receive the wireless signal corresponding to the user input from the remote controller 112*a*, and output an electrical signal corresponding to the user input to the controller 130.

The content receiver 120 may include a receiving terminal 121 and a tuner 122 that receive video and/or audio signals from content sources.

The reception terminal 121 may receive a video signal and an audio signal from content sources through a cable. In other words, the display apparatus 1 may receive a video signal and an audio signal from content sources through the reception terminal 121.

For example, the receiving terminal 121 may include a component (YPbPr/RGB) terminal, a composite (composite video blanking and sync, CVBS) terminal, an audio terminal, a High Definition Multimedia Interface (HDMI) terminal, a universal serial bus (USB) terminal, and the like.

The tuner 122 may receive a broadcast signal from a broadcast reception antenna or a wired cable, and extract a broadcast signal of a channel selected by the user from among the broadcast signals. For example, the tuner 122 may pass a broadcast signal having a frequency corresponding to a channel selected by the user among a plurality of broadcast signals received through the broadcast reception antenna or the wired cable, and block a broadcast signal having a different frequency.

As such, the content receiver 120 may receive video signals and audio signals from content sources through the reception terminal 121 and/or the tuner 122, and the video signal and the audio signal received through the reception terminal 121 and/or the tuner 122 may be output to the controller 130.

The controller 130 may include a microprocessor 131 and a memory 132.

The memory 132 may store programs and data for controlling the display apparatus 1 and temporarily store data issued while controlling the display apparatus 1.

Further, the memory 132 may store programs and data for processing video signals and/or audio signals, and temporarily store data issued during processing of the video signals and/or audio signals.

The memory 132 includes a non-volatile memory such as read only memory (ROM) for storing data for a long period of time, flash memory, and the like, and a volatile memory such as static random access memory (S-RAM) and dynamic random access memory (D-RAM) for temporarily storing data.

The microprocessor 131 may receive the user input from the user input 110 and generate a control signal for controlling the content receiver 120 and/or the image display 140 and/or the audio output 150 according to the user input.

In addition, the microprocessor 131 may receive a video signal and/or an audio signal from the content receiver 120, decode the video signal to generate image data, decode the audio signal and generate sound data. The image data and the audio data can be output to the image display 140 and the audio output 150, respectively.

The microprocessor 131 may include an operation circuit that performs logical operations and arithmetic operations, and a memory circuit that stores the calculated data.

The controller 130 can control the operation of the content receiver 120, the image display 140 and the audio output 150 according to the user input. For example, when a content source is selected by the user input, the controller 130 may control the content receiver 120 to receive a video signal and/or audio signal from the selected content source.

In addition, the controller 130 may process the video signal and/or audio signal received by the content receiver 120, and play video and audio from the video signal and/or audio signal. Specifically, the controller 130 may decode a video signal and/or audio signal, and restore image data and audio data from the video signal and/or audio signal.

The controller 130 may be implemented as the control circuit in the power supply/control unit 60 previously described with reference to FIGS. 2 and 3.

The image display 140 includes a display panel 300 for visually displaying an image and a display driver 200 for driving the display panel 300.

The display panel 300 may generate an image according to image data received from the display driver 200 and display the image.

The display panel 300 may include pixels as a unit for displaying an image. Each pixel may receive an electrical signal representing an image from the display driver 200 and output an optical signal corresponding to the received electrical signal. As such, one image may be displayed on the display panel 300 by combining optical signals output from a plurality of pixels.

The display panel 300 may be implemented with the liquid crystal panel 20 described with reference to FIGS. 2 and 3.

The display driver 200 may receive the image data from the controller 130 and drive the display panel 300 to display the image corresponding to the received image data. Specifically, the display driver 200 may transmit an electrical signal corresponding to image data to each of a plurality of pixels constituting the display panel 300.

When the display driver 200 transmits an electrical signal corresponding to image data to each pixel constituting the display panel 300, each pixel outputs light corresponding to the received electrical signal, and light output from each pixel may be combined to form a single image.

The display driver 200 may be implemented as a driving circuit of the display drive unit 20*b* (see FIG. 2) described with reference to FIG. 2.

The audio output 150 includes an amplifier 151 that amplifies sound and a speaker 152 that audibly outputs the amplified sound.

The controller 130 can convert the audio data decoded from the audio signal into an analog audio signal, and the amplifier 151 may amplify the analog sound signal output from the controller 130.

The speaker 152 may convert the analog sound signal amplified by an amplifier 181 into sound (sound wave). For example, the speaker 182 may include a thin film that vibrates according to an electrical acoustic signal, and sound waves may be generated by vibration of the thin film.

The power supplier 160 can supply power to the user input 110, the content receiver 120, the controller 130, the image display 140, the audio output 150 and all other components.

The power supplier 160 includes a switching mode power supply 161 (hereinafter referred to as 'SMPS').

The SMPS 161 may include an AC-DC converter that converts AC power of an external power source into DC power, and a DC-DC converter that changes the voltage of the DC power. For example, AC power of an external power source is converted to DC power by the AC-DC converter, and the voltage of the DC power can be changed to various voltages (for example, 5V and/or 15V) by the DC-DC converter. The DC power whose voltage is changed can be supplied to the user input 110, the content receiver 120, the controller 130, the image display 140, the audio output 150, and all other components, respectively.

Figure 5:
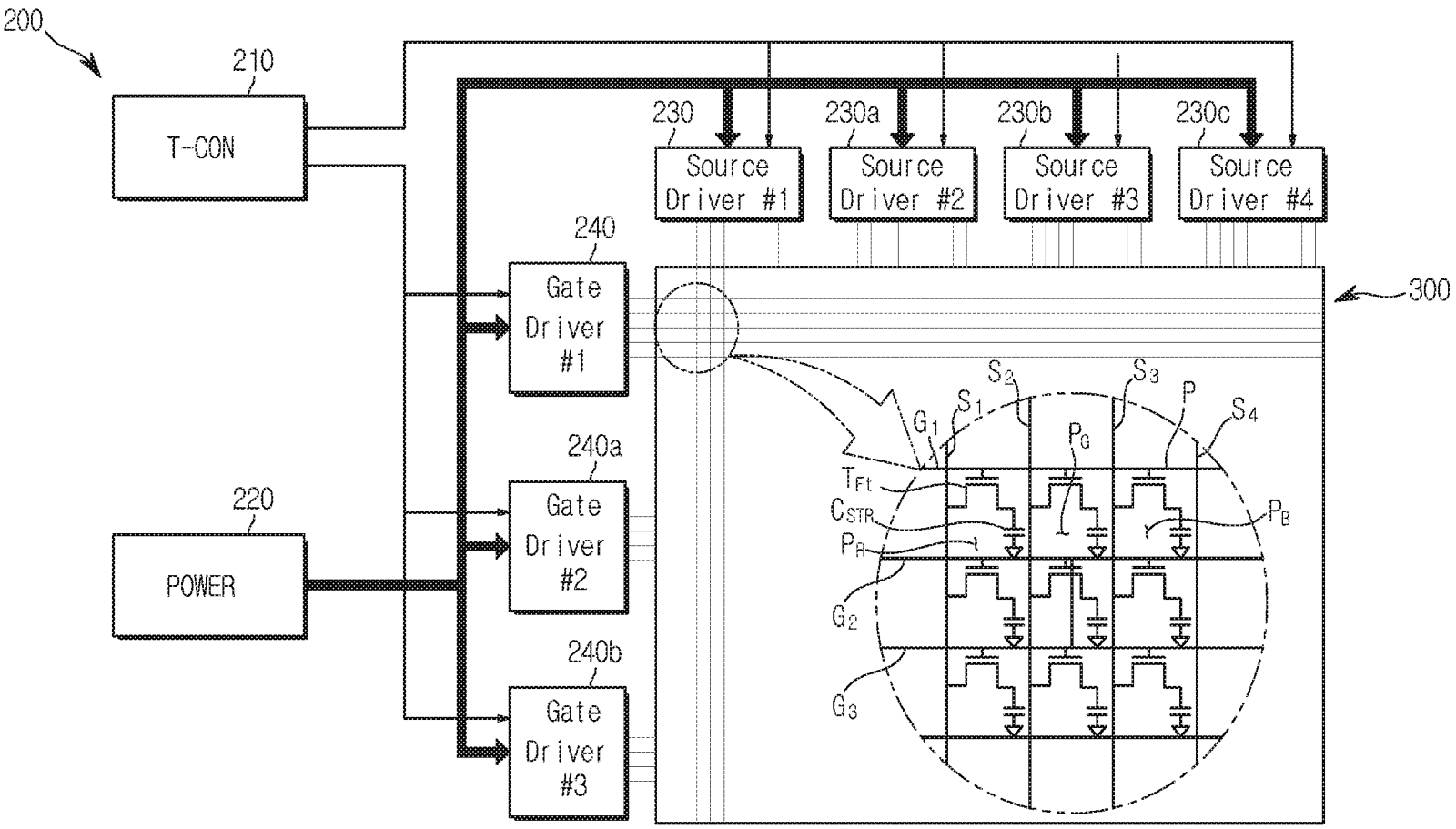
FIG. 5 is a view illustrating a display driver and a display panel included in a display apparatus according to an embodiment.

FIG. 5 is a view illustrating a display driver and a display panel included in a display apparatus according to an embodiment.

The display panel 300 may display an image by converting an electrical signal into an optical signal.

The display driver 200 may control the display panel 300 to receive image data from the controller 130 and display an image corresponding to the image data. For example, the display driver 200 may sequentially provide image data to the plurality of pixels P included in the display panel 300, and each of the plurality of pixels P may emit light having various brightness and various colors according to the image data.

The display panel 300 may include the plurality of pixels P as illustrated in FIG. 5, and each of the plurality of pixels P may include the red sub-pixel $P_R$, the green sub-pixel $P_G$, and the blue sub-pixel $P_B$.

The plurality of sub-pixels $P_R$, $P_G$, and $P_B$ may be arranged in two dimensions on the display panel 300. For example, the plurality of sub-pixels $P_R$, $P_G$, and $P_B$ may be arranged in a matrix on the display panel 300. In other words, the plurality of sub-pixels $P_R$, $P_G$, and $P_B$ may be arranged in rows and columns.

Also, the sub-pixels $P_R$, $P_G$, and $P_B$ may be divided into a plurality of gate lines $G_1$, $G_2$, and $G_3$ and a plurality of source lines $S_1$, $S_2$, and $S_3$. The plurality of gate lines $G_1$, $G_2$, and $G_3$ is connected to a gate driver 240 to be described below, and the plurality of source lines $S_1$, $S_2$, and $S_3$ may be connected to a source driver 230 described below.

Each of the plurality of sub-pixels $P_R$, $P_G$, and $P_B$ may include a thin film transistor TFT and a storage capacitor $C_{STR}$.

The storage capacitor $C_{STR}$ stores image data provided to each of the plurality of sub-pixels $P_R$, $P_G$, and $P_B$ from the source driver 230 (exactly, electric charge by image data) and outputs a voltage corresponding to the image data. The plurality of sub-pixels $P_R$, $P_G$, and $P_B$ may emit light having a brightness corresponding to the voltage output from the storage capacitor $C_{STR}$.

The thin film transistor TFT may allow or block image data from being supplied to the storage capacitor $C_{STR}$. Since the image data is continuously provided from the source driver 230, the thin film transistor TFT may allow appropriate image data to be selectively supplied to the storage capacitor $C_{STR}$ among the image data continuously provided.

The gate terminal of the thin film transistor TFT is connected to the gate line $G_1$, $G_2$, or $G_3$, the source terminal is connected to the source line $S_1$, $S_2$, or $S_3$, and the drain terminal may be connected to the storage capacitor $C_{STR}$.

The display driver 200 includes a timing controller 210, a driver power supply 220, the source driver 230, and the gate driver 240 as shown in FIG. 5.

The timing controller 210 may receive image data from the controller 130 and output the image data and a driving control signal to the source driver 230 and the gate driver 240.

The image data may include color information and brightness information for each of the plurality of pixels P. Specifically, the image data includes R image data, G image data, and B image data (hereinafter referred to as "RGB image data") for each of the sub pixels $P_R$, $P_G$, and $P_B$ included in the plurality of pixels P. The R image data includes brightness information of the red sub-pixel $P_R$, the G image data includes brightness information of the green sub-pixel $P_G$, and the B image data includes brightness information of the blue sub-pixel $P_B$. For example, the RGB image data may represent a luminance value representing brightness as 8-bit data, and the luminance value may have a value between '255' representing maximum brightness and '0' representing lowest brightness.

The driving control signal may include a gate control signal and a source control signal, and each control signal may control the operation of the gate driver 240 and the operation of the source driver 230.

The source driver 230 may receive RGB image data and a source control signal from the timing controller 210 and output the RGB image data to the display panel 300 according to the source control signal. Specifically, the source driver 230 receives digital RGB image data from the timing controller 210, converts the digital RGB image data to an analog RGB image signal, and provides the analog RGB image signal to the display panel 300.

The plurality of outputs of the source driver 230 may be respectively connected to the plurality of source lines $S_1$, $S_2$, and $S_3$ of the display panel 300, and the source driver 230 may output an RGB image signal to each of the plurality of sub-pixels $P_R$, $P_G$, and $P_B$ through the plurality of source lines $S_1$, $S_2$, and $S_3$. In particular, the source driver 230 may simultaneously output an RGB image signal to each of the plurality of sub-pixels $P_R$, $P_G$, and $P_B$ included in the same row on the display panel 300.

The display driver 200 may include the source driver 230 and a plurality of source drivers 230*a*, 230*b*, and 230*c* as shown in FIG. 5. Each of the plurality of source drivers 230, 230*a*, 230*b*, and 230*c* may output an RGB image signal to each of the plurality of sub-pixels $P_R$, $P_G$, and $P_B$.

The gate driver 240 may receive a gate control signal from the timing controller 210 and activate any one of the plurality of gate lines $G_1$, $G_2$, and $G_3$ according to the gate control signal. For example, the gate driver 240 may output an analog activation signal among the plurality of gate lines $G_1$, $G_2$, and $G_3$ according to the gate control signal.

As described above, the source driver 230 may output an RGB image signal through the plurality of source lines $S_1$, $S_2$, and $S_3$. At this time, the RGB image signal output by the source driver 230 may be provided to all the sub-pixels $P_R$, $P_G$, and $P_B$ of the display panel 300 along the plurality of source lines $S_1$, $S_2$, and $S_3$.

The gate driver 240 may provide an RGB image signal to the sub-pixels $P_R$, $P_G$, and $P_B$ in an appropriate row among the sub-pixels $P_R$, $P_G$, and $P_B$ of the display panel 300. Any one of the plurality of gate lines $G_1$, $G_2$, and $G_3$ may be activated. Accordingly, the thin film transistor TFT connected to the activated gate line $G_1$, $G_2$, or $G_3$ is turned on, and an RGB image signal may be transmitted to the storage capacitor $C_{STR}$ through the turned on thin film transistor TFT.

In addition, the display driver 200 may include the gate driver 240 and a plurality of gate drivers 240*a*, and 240*b* as shown in FIG. 5. Each of the plurality of gate drivers 240, 240*a*, and 240*b* may activate data input to the sub-pixels $P_R$, $P_G$, and $P_B$ of an appropriate row.

The driver power supply 220 may supply DC power of various voltages to the source driver 230 and the gate driver 240.

The source driver 230 may include digital circuits for processing RGB image data and source control signals, respectively, and analog circuits for driving the display panel 300. In addition, the gate driver 240 may include a digital circuit processing the gate control signal and an analog circuit driving the display panel 300.

The digital circuit and the analog circuit may be supplied with DC power of different voltages. For example, a low voltage (e.g., 5V) DC power is supplied to the digital circuit to reduce power consumption, and a high voltage (e.g., 15V) DC power is supplied to the analog circuit to drive the display panel 300.

Accordingly, the driver power supply 220 may supply DC power having at least two different voltages to the source driver 230 and the gate driver 240.

The driver power supply 220 may receive DC power from the power supplier 160 of the display apparatus 1, change the voltage of the supplied DC power, and supply it to the source driver 230 and the gate driver 240. For example, the driver power supply 220 may include a charge pump circuit for increasing the voltage of the DC power supplied from the power supplier 160, and the DC power boosted by the charge pump circuit and the DC power supplied from the power supplier 160 may be supplied to the source driver 230 and the gate driver 240.

As such, the source driver 230 and the gate driver 240 may sequentially output RGB image signals to the plurality of sub-pixels $P_R$, $P_G$, and $P_B$ included in the display panel 300.

Information by the RGB image signal output from the source driver 230 may be stored in the storage capacitor $C_{STR}$ provided in each of the plurality of sub-pixels $P_R$, $P_G$, and $P_B$, the storage capacitor $C_{STR}$ may apply a voltage corresponding to the RGB image signal between the pixel electrode 23 (see FIG. 3) and the common electrode 26 (see FIG. 3). In other words, a voltage corresponding to the RGB image signal is applied to the liquid crystal layer 25 (see FIG. 3), and an electric field corresponding to the RGB image signal may be formed in the liquid crystal layer 25.

The arrangement of the liquid crystal molecules 25*a* (see FIG. 3) is changed by the electric field formed in the liquid crystal layer 25, and the optical properties of the liquid crystal layer 25 of the sub-pixels $P_R$, $P_G$, and $P_B$ change. The sub-pixels $P_R$, $P_G$, or $P_B$ may transmit light or block light by changing the optical properties of the liquid crystal layer 25, and an image may be formed on the display panel 300.

At this time, when the electric field in the same direction is repeatedly formed in the liquid crystal layer 25, the change in the arrangement of the liquid crystal molecules 25*a* due to the electric field is weakened. For example, when a positive voltage (normal voltage) is repeatedly applied to both ends of the liquid crystal layer 25, a change in the arrangement of the liquid crystal molecules 25*a* due to the electric field is weakened, and thus afterimages may occur on the display panel 300.

To prevent this, the source driver 230 may control the display panel 300 to periodically (e.g., every frame) form an electric field in the opposite direction on the liquid crystal layer 25. For example, the source driver 230 may provide an RGB video signal to apply the positive voltage (normal voltage) and the negative voltage (inverting voltage) alternately applied to each of the sub pixels $P_R$, $P_G$, or $P_B$.

The source driver 230 may generate a normal voltage signal (a positive voltage signal based on the common voltage) and an inverted voltage signal (a negative voltage signal based on the common voltage). The source driver 230 generates a normal voltage signal from the sum of a common voltage $V_{COM}$ and an RGB image signal, and an inverted voltage signal can be generated from the difference between the common voltage $V_{COM}$ and the RGB video signal. Here, the common voltage $V_{COM}$ is a reference voltage value of the normal RGB image signal and the inverted RGB image signal, and the common voltage $V_{COM}$ may be a voltage of '0V' depending on the display panel, or may be half of the voltage applied to the display panel from the power supplier 160.

Also, the source driver 230 may alternately output a normal voltage signal and an inverted voltage signal to each of the sub-pixels $P_R$, $P_G$, or $P_B$. For example, the source driver 230 outputs a normal voltage signal to the red sub-pixel $P_R$ in a first column, outputs an inverted voltage signal to the green sub-pixel $P_G$ in a second column, and outputs a normal voltage signal to the blue sub-pixel $P_B$ of a third column. Further, an inverted voltage signal is output to the red sub-pixel $P_R$ in a fourth column, a normal voltage signal is output to the green sub-pixel $P_G$ in a fifth column, and an inverted voltage signal is output to the blue sub-pixel $P_B$ of a sixth column.

The sub-pixels $P_R$, $P_G$, or $P_B$ disposed in the same row may share the one common electrode 26, and a voltage by an RGB image signal may be applied to the sub-pixels $P_R$, $P_G$, or $P_B$ arranged in the same row based on the voltage value of the one common electrode 26. At this time, the voltage value of the common electrode 26 may be different from the common voltage $V_{COM}$. For example, the voltage value of the common electrode 26 may vary depending on the voltage value of the normal voltage signal and the voltage value of the inverted voltage signal output from the source driver 230.

Figure 6:
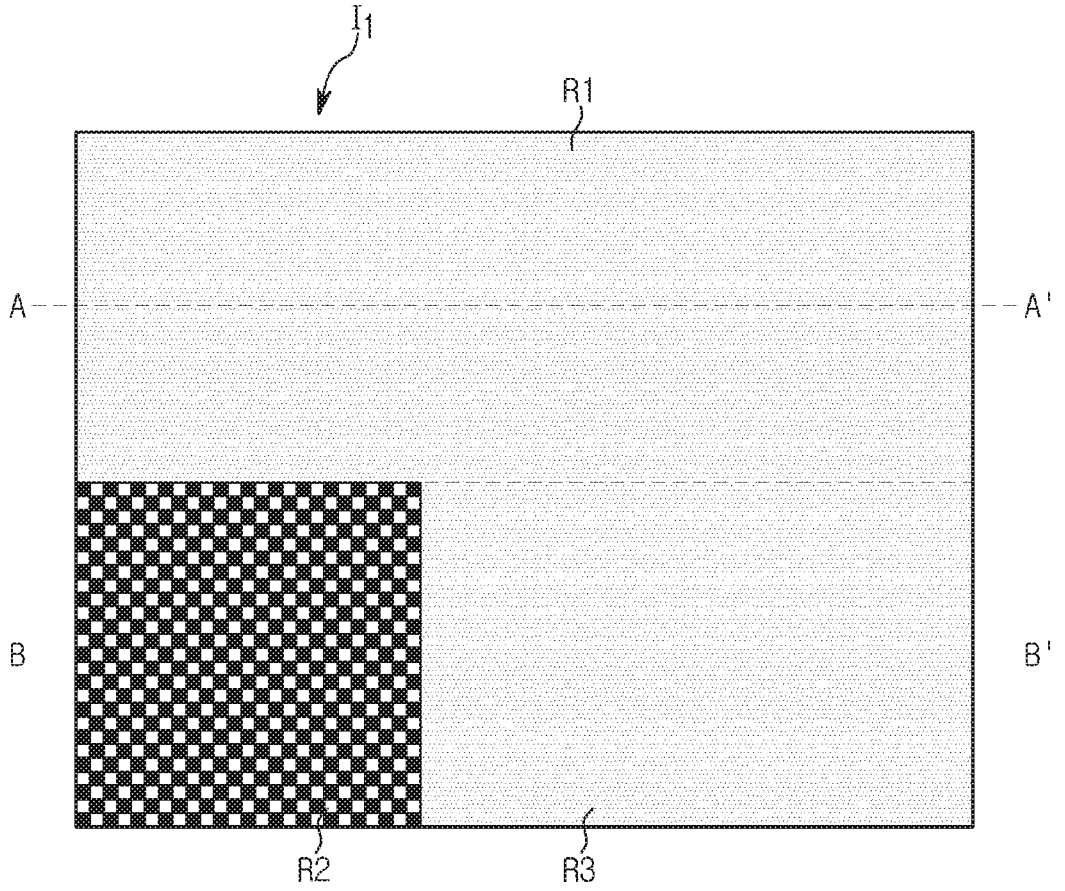
FIG. 6 shows an example of an image.

FIG. 6 shows an example of an image.

As illustrated in FIG. 6, an image $I_1$ displayed on the display apparatus 1 includes a first region $R_1$ made of a single color and a second region $R_2$ formed with a checkered pattern in which two different colors cross each other, and a third region $R_3$ made of a single color may be included.

In particular, the second region $R_2$ and the third region $R_3$ may be arranged side by side. In other words, the second region $R_2$ and the third region $R_3$ may be located on the same row, and the first region $R_1$ may be located on a row different from the second and third regions $R_2$ and $R_3$.

In addition, images having the same brightness and the same color may be displayed on the first region $R_1$ and the third region $R_3$, and in the second region $R_2$, an image including a checkered pattern in which white and black are repeated for each of the pixels P may be displayed.

Figure 7A:
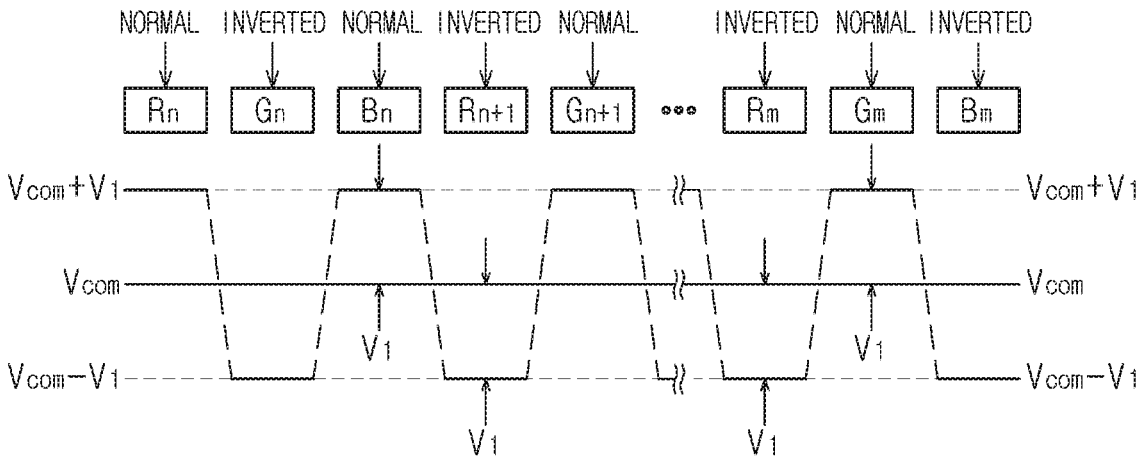
FIGS. 7A and 7B shows a voltage of an electrode passing through straight line A-A' and a voltage of an electrode passing through straight line B-B' on the image shown in FIG. 6.
Figure 7B:
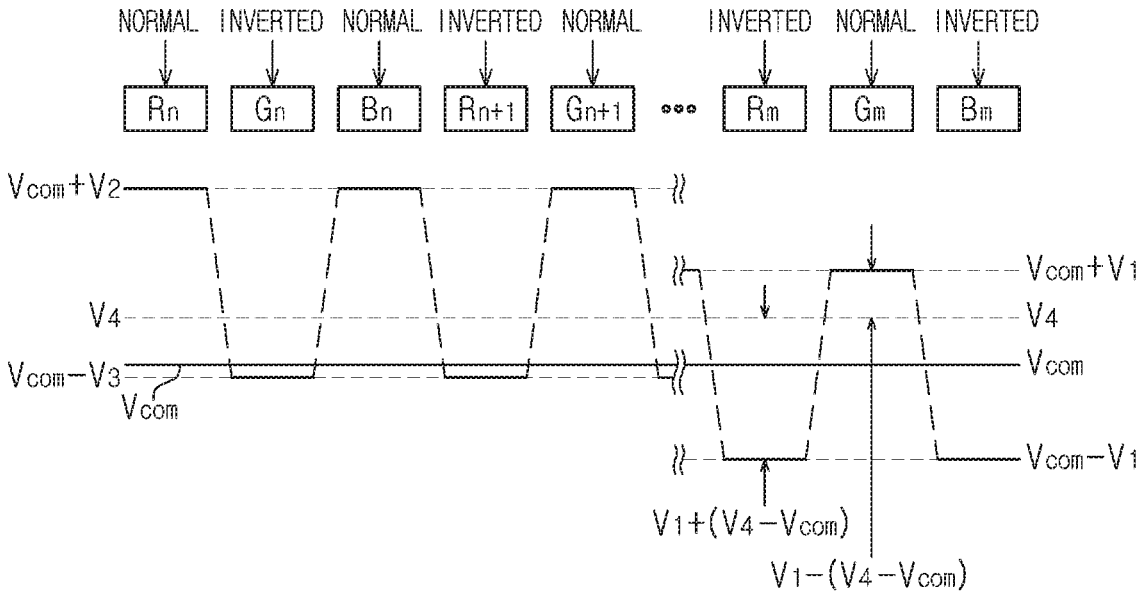

FIG. 7 shows a voltage of an electrode passing through straight line A-A' and a voltage of an electrode passing through straight line B-B' on the image shown in FIG. 6. Specifically, FIG. 7A shows a voltage due to a normal/inverted voltage signal input to the first region $R_1$ of the image $I_1$ and the voltage of the common electrode shown in FIG. 6, and FIG. 7B shows voltages of the common electrode and the voltage due to the normal/inverted voltage signals input to the second and third regions $R_2$ and $R_3$ of the image $I_1$ shown in FIG. 6.

Referring to FIG. 7A, normal voltage signals and inverted voltage signals may be alternately input to sub pixels $P_{Rn}$, $P_{Gn}$, $P_{Bn}$, . . . $P_{Rm}$, $P_{Gm}$, and $P_{Bm}$ of the first region $R_1$. For example, the sub-pixels $P_{Rn}$, $P_{Gn}$, $P_{Bn}$, . . . $P_{Rm}$, $P_{Gm}$, and $P_{Bm}$ of the first region $R_1$ may be alternately input a sum $V_{COM}+V_1$ of the common voltage $V_{COM}$ and the first voltage $V_1$ and a difference $V_{COM}-V_1$ between the common voltage $V_{COM}$ and the first voltage. The sum $V_{COM}+V_1$ of the common voltage $V_{COM}$ and the first voltage $V_1$ is input to the n-th red sub-pixel $P_{Rn}$ of the first region $R_1$, the difference $V_{COM}-V_1$ between the common voltage $V_{COM}$ and the first voltage $V_1$ is input to the n-th green sub-pixel $P_{Gn}$, and the sum $V_{COM}+V_1$ of the common voltage $V_{COM}$ and the first voltage $V_1$ may be input to the n-th blue sub-pixel $P_{Bn}$.

The average of the voltages $V_{COM}+V_1$, $V_{COM}-V_1$, $V_{COM}+V_1$, . . . input to the sub-pixels $P_{Rn}$, $P_{Gn}$, $P_{Bn}$, . . . $P_{Rm}$, $P_{Gm}$, and $P_{Bm}$ of the first region $R_1$ is approximately the common voltage $V_{COM}$, and the voltage of the common electrode 26 may be approximately equal to the common voltage $V_{COM}$.

The positive and negative first voltages $V_1$ are applied to the liquid crystal layer of the sub-pixels $P_{Rn}$, $P_{Gn}$, $P_{Bn}$, . . . $P_{Rm}$, $P_{Gm}$, and $P_{Bm}$ of the first region $R_1$, and an image (e.g., a gray image) having the same brightness and the same color may be displayed on the first region $R_1$.

Referring to FIG. 7B, normal voltage signals and inverted voltage signals may be alternately input to the sub pixels $P_{Rn}$, $P_{Gn}$, and $P_{Bn}$ of the second region $R_2$. For example, the sub-pixels $P_{Rn}$, $P_{Gn}$, and $P_{Bn}$ of the second region $R_2$ may be alternately input a sum $V_{COM}+V_2$ of the common voltage $V_{COM}$ and the second voltage $V_2$, and a difference $V_{COM}-V_3$ between the common voltage $V_{COM}$ and the third voltage $V_3$. The sum $V_{COM}+V_2$ of the common voltage $V_{COM}$ and the second voltage $V_2$ is input to the n-th red sub-pixel $P_{Rn}$ of the second region $R_2$, the difference $V_{COM}-V_3$ between the common voltage $V_{COM}$ and the third voltage $V_3$ is input to the n-th green sub-pixel $P_{Gn}$, and the sum $V_{COM}+V_2$ of the common voltage $V_{COM}$ and the second voltage $V_2$ may be input to the n-th blue sub-pixel $P_{Bn}$.

The average of the voltages $V_{COM}+V_1$, $V_{COM}-V_1$, $V_{COM}+V_1$, . . . input to the sub-pixels $P_{Rn}$, $P_{Gn}$, $P_{Bn}$, . . . $P_{Rm}$, $P_{Gm}$, and $P_{Bm}$ of the first region $R_1$ is approximately the common voltage $V_{COM}$, and the voltage of the common electrode 26 may be approximately equal to the common voltage $V_{COM}$.

In the sub-pixels $P_{Rn}$, $P_{Gn}$, and $P_{Bn}$ of the third region $R_3$, as in the first region $R_1$, the sum $V_{COM}+V_1$ of the common voltage $V_{COM}$ and the first voltage $V_1$, and the difference $V_{COM}-V_1$ of the common voltage $V_{COM}$ and the first voltage $V_1$ may be alternately input. For example, the sum $V_{COM}+V_1$ of the common voltage $V_{COM}$ and the first voltage $V_1$ is input to the m-th red sub-pixel $P_{Rm}$ of the third region $R_3$, the difference $V_{COM}-V_1$ between the common voltage $V_{COM}$ and the first voltage $V_1$ is input to the m-th green sub-pixel $P_{Gm}$, and the sum $V_{COM}+V_1$ of the common voltage $V_{COM}$ and the first voltage $V_1$ may be input to the m-th blue sub-pixel $P_{Bm}$.

Here, the second voltage $V_2$ is different from the third voltage $V_3$ and may be a voltage greater than the third voltage $V_3$. Accordingly, the average of the voltages $V_{COM}+V_2$, $V_{COM}-V_3$, $V_{COM}+V_2$ input to the sub pixels $P_{Rn}$, $P_{Gn}$, $P_{Bn}$, . . . $P_{Rm}$, $P_{Gm}$, and $P_{Bm}$ of the second region $R_2$ and the third region $R_3$ may be different from the common voltage $V_{COM}$. Further, the voltage of the common electrode 26 may be a fourth voltage $V_4$ different from the common voltage $V_{COM}$.

As a result, a voltage different from the first voltage $V_1$ may be applied to the liquid crystal layer of the sub-pixels $P_{Rm}$, $P_{Gm}$, and $P_{Bm}$ of the third region $R_3$. For example, a voltage $V_1+(V_4-V_{COM})$ is applied to the red sub-pixel $P_{Rm}$ in the third region $R_3$, and the voltage $V_1-(V_4-V_{COM})$ is applied to the green sub-pixel $P_{Gm}$, and the voltage $V_1+(V_4-V_{COM})$ may be applied to the blue sub-pixel $P_{Bm}$.

Further, when comparing the first region $R_1$ and the third region $R_3$, the RBG image data of the first region $R_1$ and the RBG image data of the third region $R_3$ are the same, and the voltage applied to the sub-pixels $P_{Rm}$, $P_{Gm}$, and $P_{Bm}$ of the first region $R_1$ is different from the voltage applied to the sub-pixels $P_{Rm}$, $P_{Gm}$, and $P_{Bm}$ of the third region $R_3$. Accordingly, different brightness and different colors may be displayed on the first region $R_1$ and the third region $R_3$, and due to the visual difference between the first region $R_1$ and the third region $R_3$, a boundary line between the first region $R_1$ and the third region $R_3$ may be recognized.

As a result, a visual difference occurs between the first region $R_1$ and the third region $R_3$ displaying the same image due to the image of the second region $R_2$, and a boundary line between the first region $R_1$ and the third region $R_3$ may be recognized.

As such, visual coupling of an image may occur due to interference between pixels or the sub-pixels $P_{Rn}$, $P_{Gn}$, $P_{Bn}$, . . . , $P_{Rm}$, $P_{Gm}$, and $P_{Bm}$. This visual defect is called crosstalk.

To reduce or eliminate such crosstalk, the display apparatus 1 may perform the following operations.

Figure 8:
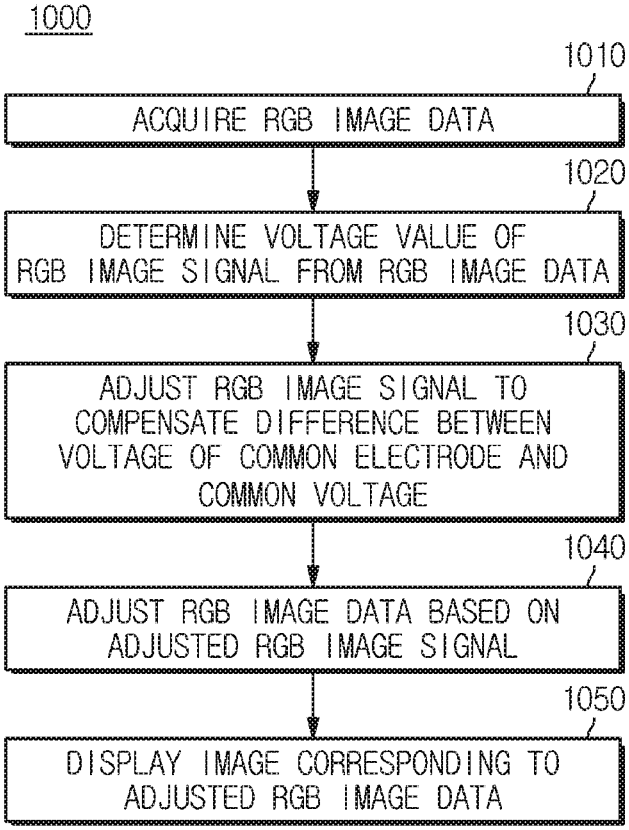
FIG. 8 is a view illustrating an example of an operation of reducing crosstalk in a display apparatus according to an embodiment.
Figure 9A:
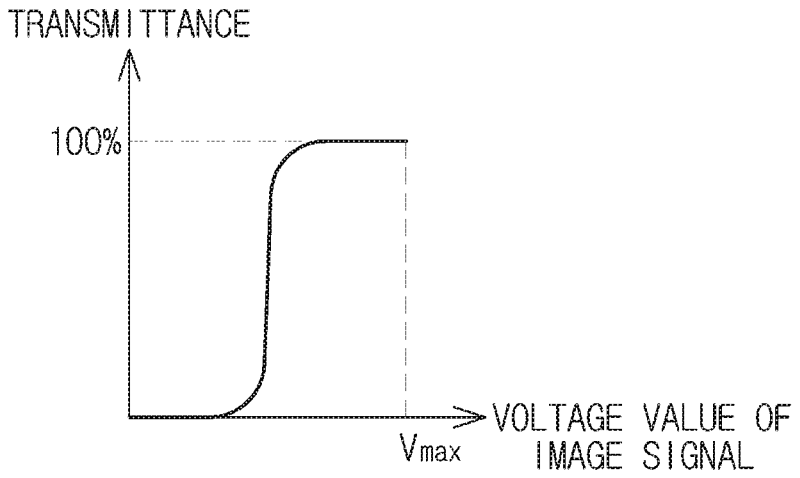
FIGS. 9A and 9B are views illustrating characteristics of a display panel included in a display apparatus according to an embodiment.
Figure 10:
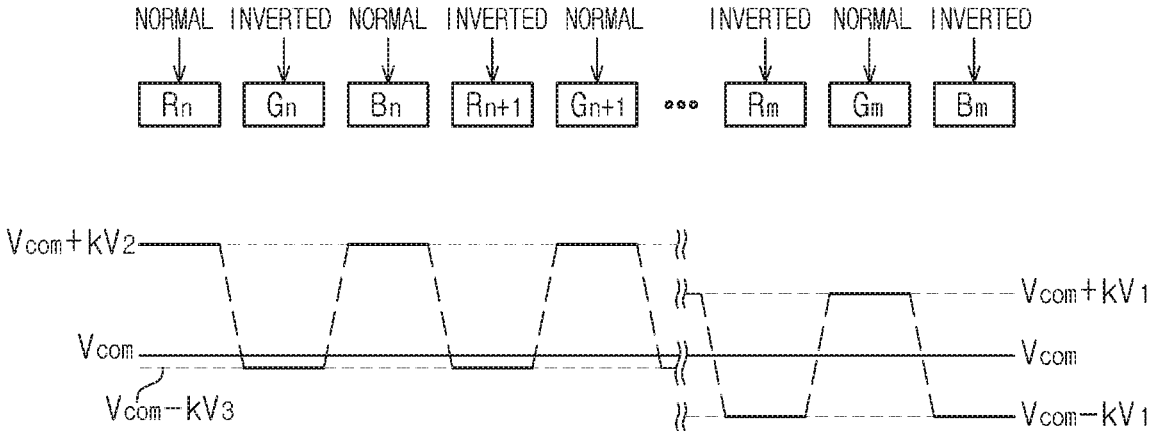
FIGS. 10, 11 and 12 show a voltage of a common electrode and a voltage of a pixel electrode by the crosstalk reduction operation shown in FIG. 8.
Figure 11:
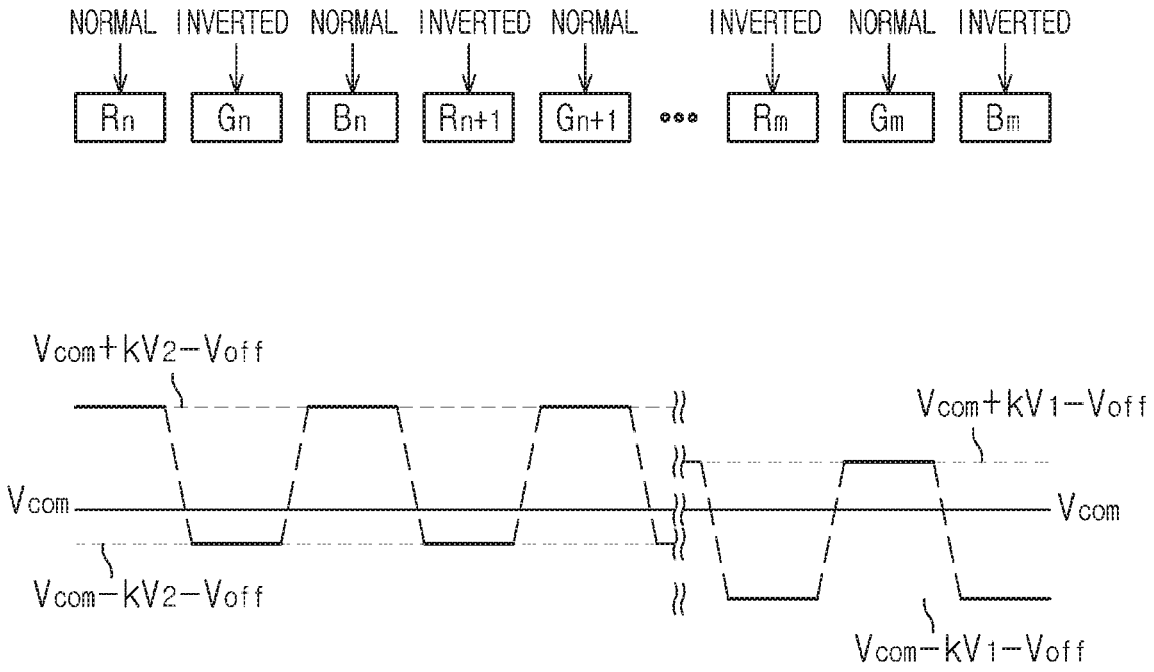
Figure 12:
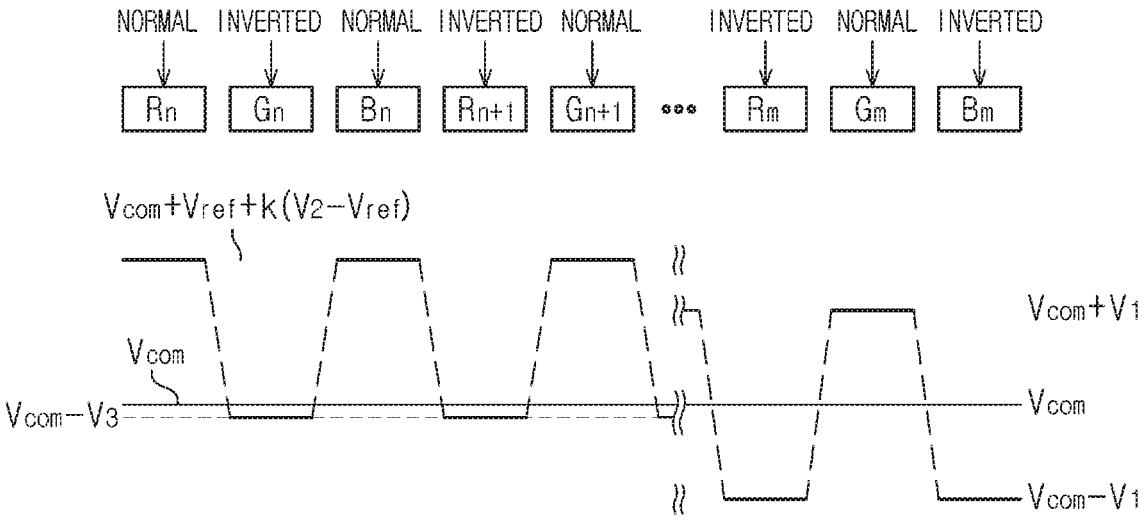

FIG. 8 is a view illustrating an example of an operation of reducing crosstalk in a display apparatus according to an embodiment. FIG. 9 is a view illustrating characteristics of a display panel included in a display apparatus according to an embodiment. FIGS. 10, 11 and 12 show a voltage of a common electrode and a voltage of a pixel electrode by the crosstalk reduction operation shown in FIG. 8.

With FIGS. 8, 9, 10, 11 and 12, a crosstalk reduction operation 1000 of the display apparatus 1 is described.

The display apparatus 1 acquires RGB image data of the pixels P (1010).

The controller 130 may decode a video signal received by the content receiver 120, and generate RGB image data for playing an image from the video signal. The RGB image data may include a luminance value of the red sub-pixel $P_R$, a luminance value of the green sub-pixel $P_G$, and a luminance value of the blue sub-pixel $P_B$, and each of the luminance values can be expressed as 8-bit or 10-bit data.

The controller 130 can output RGB image data to the timing controller 210 of the image display 140, and the timing controller 210 may receive the RGB image data from the controller 130.

Thereafter, the display apparatus 1 determines the voltage value of the RGB image signal from the RGB image data (1020).

The source driver 230 of the image display 140 receives digital RGB image data from the timing controller 210, converts the digital RGB image data to an analog RGB image signal, and provides the analog RGB image signal to the display panel 300.

Each of the pixels P of the display panel 300 may transmit or emit light in response to the RGB image signal of the source driver 230. For example, the voltage value applied to the pixels P of the display panel 300 (the voltage value of the RGB image signal) and the light transmittance of the pixels P of the display panel 300 are shown in FIG. 9A. Since the amount of light emitted from the pixels P is defined according to the light transmittance of the pixels P, the light transmittance of the pixels P may correspond to the luminance value of the pixels P.

Since the RGB image data includes information (luminance values) about the brightness of each of the sub-pixels $P_R$, $P_G$, and $P_B$, the light transmittance of FIG. 9A may correspond to the luminance value of the RGB image data.

Figure 9B:
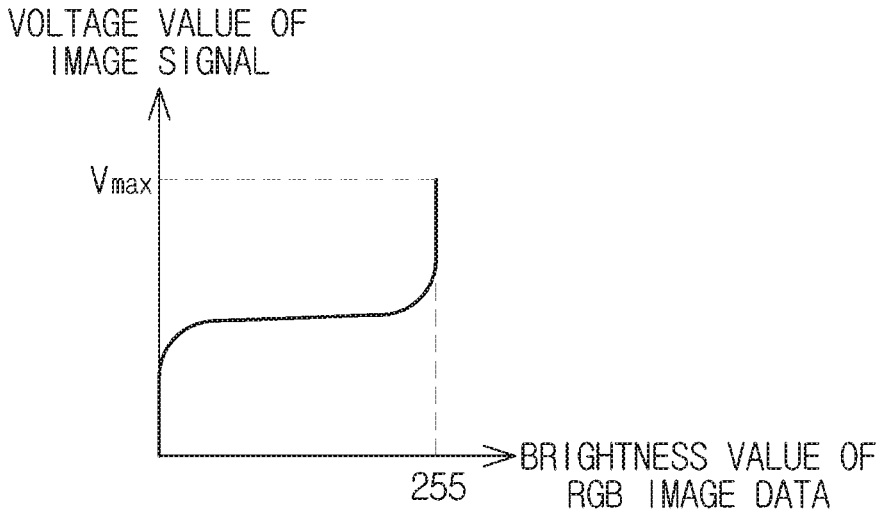

Therefore, based on the characteristic curve of the display panel 300 shown in FIG. 9A, as illustrated in FIG. 9B, a graph showing the relationship between the luminance value of the RGB image data and the voltage value of the RGB image signal may be derived.

The timing controller 210 may include a lookup table corresponding to the graph shown in FIG. 9B. In other words, the timing controller 210 may include a lookup table that stores RGB image data and corresponding RGB image signals, and determines the voltage value of the RGB image signal corresponding to the luminance value of the RGB image data using the lookup table.

Thereafter, the display apparatus 1 adjusts the RGB image signal to compensate for the difference between the voltage of the common voltage $V_{COM}$ and the voltage of the common electrode 26 (1030).

The timing controller 210 determines the voltage value of the normal voltage signal applied to the pixel electrode 23 and the voltage value of the inverted voltage signal based on the RGB image signal, and determines the voltage value of the common electrode 26 based on the voltage value of the normal/inverted voltage signal input to the plurality of pixels P positioned in the same row.

For example, the timing controller 210 determines the voltage of the common electrode 26 based on the total amount of charge supplied to the plurality of pixels P by the normal/inverted voltage signal and the capacitance value of the common electrode 26. The amount of charge stored in each of the plurality of pixels P may be calculated from a product of the voltage of the normal/inverted voltage signal supplied to the pixel and the capacitance value of the storage capacitor $C_{STR}$ formed in the pixel, and the total amount of charge of the plurality of pixels P may be calculated from the sum of the amount of charge of each of the plurality of pixels P. In addition, the voltage of the common electrode 26 may be calculated from a quotient of the total charge amount of the plurality of pixels P divided by the capacitance value of the common electrode 26.

As another example, the timing controller 210 calculates the voltage of the common electrode 26 from the average value of the voltage by the normal/inverted voltage signal input to the plurality of pixels P sharing the same common electrode 26.

In general, the voltage of the common electrode 26 may approximately coincide with the common voltage $V_{COM}$. On the other hand, as shown in FIG. 6, in the specific image $I_1$, the voltage of the common electrode 26 is different from the common voltage $V_{COM}$, and crosstalk of the image may occur.

The timing controller 210 may adjust the voltage of the RGB image signal in order to remove or reduce the difference between the common voltage $V_{COM}$ and the voltage of the common voltage 26.

The timing controller 210 may adjust the voltage of the RGB image signal using the following three methods.

Reducing the size of the RGB video signal at a constant ratio k.

Reducing the size of the RGB video signal at the constant ratio k, and then reducing the size of the normal/inverted voltage signal by the RGB video signal by an offset voltage Voff.

Reducing the RGB image signal larger than a reference voltage Vref at the constant ratio k.

For example, the timing controller 210 may reduce the size of the RGB image signal at the constant ratio k to compensate for the difference between the voltage of the common voltage $V_{COM}$ and the common voltage 26.

As illustrated in FIG. 9, when the size of the RGB image signal increases, the brightness of the light output from the pixel P increases substantially, and when the size of the RGB image signal decreases, the brightness of the light output by the pixel P decreases slightly. In other words, there is a relationship between the size of the RGB image signal and the brightness of the light output from the pixel P.

In addition, it is known that a person easily perceives a change in brightness in a dark image, but does not easily recognize a change in brightness in a bright image. In other words, even if the brightness of the light output by the pixel P having a large brightness of the output light changes, the person cannot easily recognize the change in the image.

Therefore, if the change in brightness of a bright pixel (a pixel having a large size of the RGB image signal) is greater than a change of brightness of a dark pixel (a pixel having a small size of the RGB image signal), the user may not be able to easily recognize the change in the image. In other words, if the size of the RGB image signal changes according to the size of the RGB image signal, the user may not be able to easily recognize the change in the image.

The timing controller 210 may reduce the size of the RGB image signal at the constant ratio k, and k may be a constant greater than '0' and less than '1.'

Referring to FIG. 10, in the sub-pixels $P_{Rn}$, $P_{Gn}$, and $P_{Bn}$ of the second region $R_2$ of the image $I_1$ shown in FIG. 6, a sum $V_{COM}+kV_2$ of the common voltage $V_{COM}$ and the second voltage $kV_2$ reduced by the constant ratio k, and a difference $V_{COM}-kV_3$ between the common voltage $V_{COM}$ and the third voltage $V_3$ reduced by the constant ratio k may be alternately input. In the sub-pixels $P_{Rm}$, $P_{Gm}$, and $P_{Bm}$ of the third region $R_3$, a sum $V_{COM}+kV_1$ of the common voltage $V_{COM}$ and the first voltage $kV_1$ reduced by the constant ratio k, and a difference $V_{COM}-kV_1$ between the common voltage $V_{COM}$ and the first voltage $kV_1$ reduced by the constant ratio k may be alternately input.

Because the size of the RGB video signal is reduced to the constant ratio k, the difference between the voltage of the common electrode 26 and the common voltage $V_{COM}$ is also reduced at the constant ratio k, therefore crosstalk of an image may be reduced.

As another example, the timing controller 210 may reduce the size of the RGB image signal to the constant ratio k to compensate for the difference between the voltage of the common voltage $V_{COM}$ and the common electrode 26. Thereafter, the timing controller 210 may further reduce the magnitude of the normal/inverted voltage signal by the RGB image signal by the offset voltage Voff.

Specifically, the timing controller 210 further reduces the size of the RGB image signal of the pixel to which the normal voltage signal is input by the offset voltage Voff, and the magnitude of the RGB image signal of the pixel to which the inverted voltage signal is input may be increased by the offset voltage Voff.

The offset voltage Voff may depend on the difference between the voltage of the common electrode 26 and the common voltage $V_{COM}$. For example, a difference between the voltage of the common electrode 26 and the common voltage $V_{COM}$ is reduced to the constant ratio k by reducing the size of the RGB image signal at the constant ratio k. The offset voltage Voff may be equal to the difference reduced by the constant ratio k. In this way, the size of the RGB video signal is reduced to the constant ratio k, and thereafter, by reducing the magnitude of the normal/inverted voltage signal by the RGB image signal by the offset voltage Voff, the difference between the voltage of the common electrode 26 and the common voltage $V_{COM}$ can be eliminated.

Referring to FIG. 11, in the sub-pixels $P_{Rn}$, $P_{Gn}$, and $P_{Bn}$ of the second region $R_2$ of the image $I_1$ shown in FIG. 6, the difference between the sum $V_{COM}+kV_2$ of the common voltage $V_{COM}$ and the adjusted second voltage $kV_2$, and the offset voltage Voff, and the difference between a difference $V_{COM}-kV_2$ of the common voltage $V_{COM}$ and the adjusted second voltage $kV_2$, and the offset voltage Voff are alternately input. Also, in the sub-pixels $P_{Rn}$, $P_{Gn}$, and $P_{Bn}$ of the third region $R_3$, the difference between the sum $V_{COM}+kV_1$ of the common voltage $V_{COM}$ and the adjusted first voltage $kV_1$, and the offset voltage Voff, and the difference between the difference $V_{COM}-kV_1$ of the common voltage $V_{COM}$ and the adjusted first voltage $kV_1$, and the offset voltage Voff are alternately input.

As a result, the difference between the voltage of the common electrode 26 and the common voltage $V_{COM}$ can be eliminated.

As another example, the timing controller 210 may reduce the RGB image signal larger than the reference voltage Vref to the constant ratio k.

Even if the brightness of a bright pixel (a pixel having a large size of the RGB image signal) changes, the user may not easily recognize the change of the image. In other words, if the size of the RGB image signal larger than the reference voltage Vref is adjusted, the user may not be able to easily recognize the change in the image.

The timing controller 210 may reduce a portion of the RGB image signal greater than the reference voltage Vref, which is greater than the reference voltage Vref, at the constant ratio k. At this time, k may be a constant greater than '0' and less than '1.'

Referring to FIG. 12, the sub-pixels $P_{Bn}$, $P_{Gn}$, and $P_{Bn}$ of the second region $R_2$ of the image $I_1$ shown in FIG. 6 are alternately input a sum $V_{COM}$+Vref+k($V_2$−Vref) between the common voltage $V_{COM}$ and the second voltage in which a portion larger than the reference voltage Vref is reduced by the constant ratio k Vref+k($V_2$−Vref), and the difference $V_{COM}-V_3$ between the common voltage $V_{COM}$ and the third voltage $V_3$. In the sub-pixels $P_{Rm}$, $P_{Gm}$, and $P_{Bm}$ of the third region $R_3$, the sum $V_{COM}+V_1$ of the common voltage $V_{COM}$ and the first voltage $kV_1$ and the difference $V_{COM}-V_1$ between the common voltage $V_{COM}$ and the first voltage $kV_1$ may be alternately input.

By adjusting the size of the RGB video signal larger than the reference voltage Vref, the difference between the voltage of the common electrode 26 and the common voltage $V_{COM}$ decreases, and crosstalk of the image may be reduced.

As such, the timing controller 210 may correct the voltage of the RGB image signal in order to remove or reduce the difference between the voltage of the common voltage $V_{COM}$ and the common electrode 26 in various ways.

Thereafter, the display apparatus 1 adjusts the RGB image data based on the corrected RGB image signal (1040).

FIG. 9A shows a voltage value (a voltage value of an RGB image signal) applied to the pixels P of the display panel 300 and a light transmittance of the pixels P of the display panel 300. Since the amount of light emitted from the pixels P is defined according to the light transmittance of the pixels P, the light transmittance of the pixels P may correspond to the luminance value of the pixels P. Since the RGB image data includes information (brightness values) about the brightness of each of the sub-pixels $P_R$, $P_G$, and $P_B$, the light transmittance of FIG. 9A may correspond to the luminance value of the RGB image data. Therefore, the graph shown in FIG. 9A shows the relationship between the voltage value of the RGB image signal and the luminance value of the RGB image data.

The timing controller 210 may include the lookup table corresponding to the graph illustrated in FIG. 9A. In other words, the timing controller 210 may include a second lookup table that stores RGB image signals and corresponding RGB image data, and determines a luminance value of the RGB image data corresponding to a voltage value of the RGB image signal using the second lookup table.

Thereafter, the display apparatus 1 displays an image corresponding to the adjusted RGB image data (1050).

The timing controller 210 may output the adjusted RGB image data together with the source control signal to the source driver 230 and the gate control signal to the gate driver 240. An image corresponding to the corrected RGB image data may be displayed on the display panel 300 by the operation of the source driver 230 and the gate driver 240.

As described above, the timing controller 210 may adjust the RGB image data in order to reduce the difference between the voltage of the common electrode 26 and the common voltage $V_{COM}$, and the crosstalk may be reduced by the adjusting of the RGB image data.

In the above, it has been described that the crosstalk of the image is reduced by the timing controller 210, but is not limited thereto.

The controller 130 may adjust the RGB image data in order to reduce the difference between the voltage of the common electrode 26 and the common voltage $V_{COM}$.

For example, the controller 130 may decode the video signal received by the content receiver 120, and generate RGB image data for playing the image from the video signal (1010). Thereafter, the controller 130 determines the voltage value of the RGB image signal from the RGB image data (1020), and adjusts the RGB image signal to compensate for a difference between the voltage of the common voltage $V_{COM}$ and the common electrode 26 (1030), and adjusts the RGB image data based on the adjusted RGB image signal (1040). Thereafter, the controller 130 may output the adjusted RGB image data to the timing controller 210. The timing controller 210 may output the adjusted RGB image data together with the source control signal to the source driver 230 and output the gate control signal to the gate driver 240 (1050).

As described above, the display apparatus 1 may reduce crosstalk of an image by an image processing operation of the timing controller 210 or the controller 130 without additional hardware. In other words, the RGB image data is corrected by the operation of the timing controller 210 or the controller 130, and crosstalk of the image may be reduced.

Figure 13:
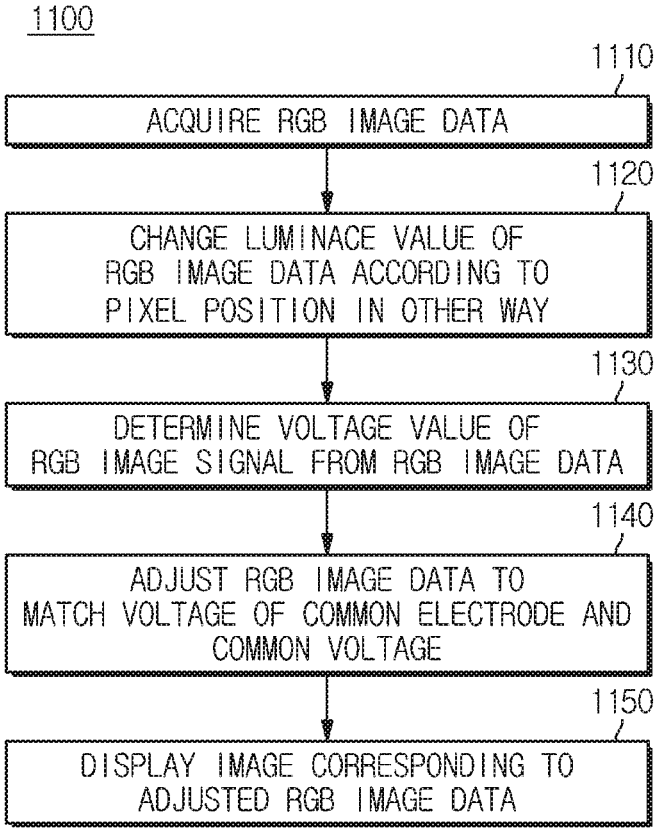
FIG. 13 is a view illustrating another example of a crosstalk reduction operation of a display apparatus according to an embodiment.
Figure 14:
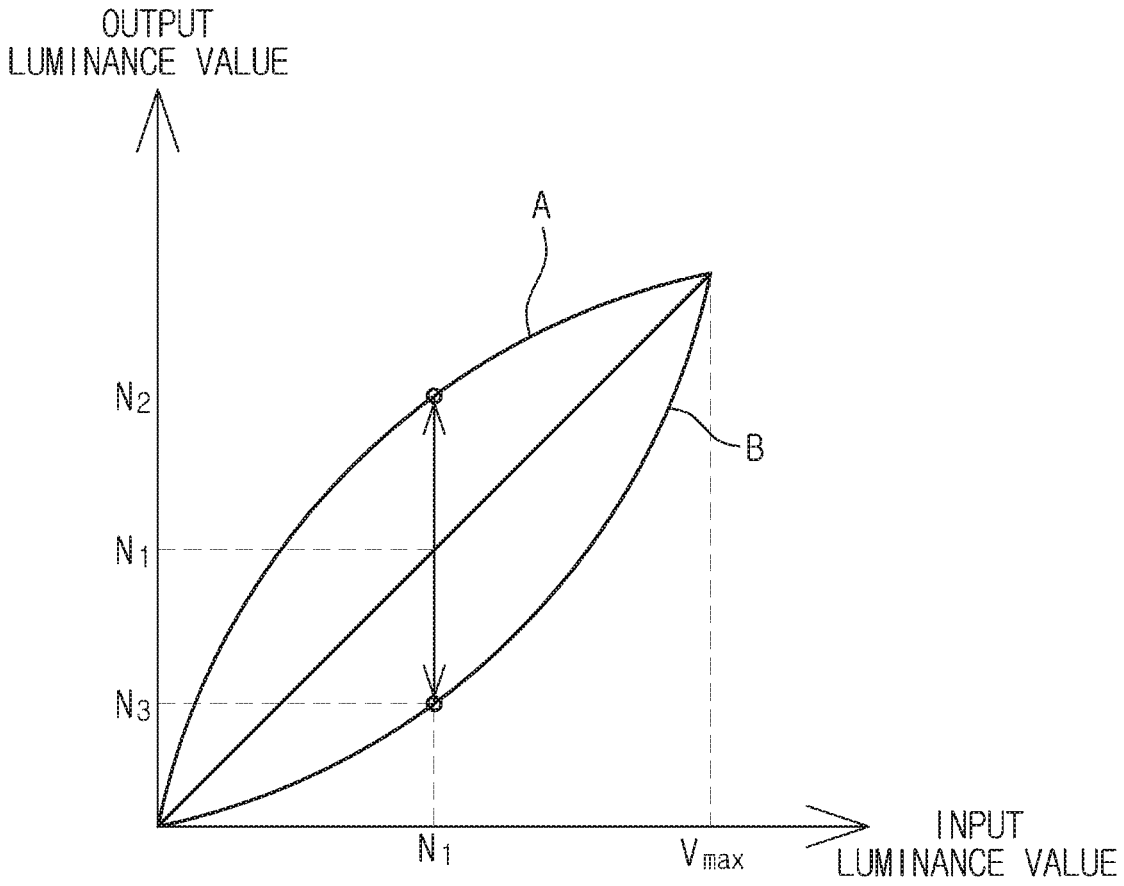
FIG. 14 illustrates an example of a mapping graph for improving a viewing angle shown in FIG. 13.
Figure 16A:
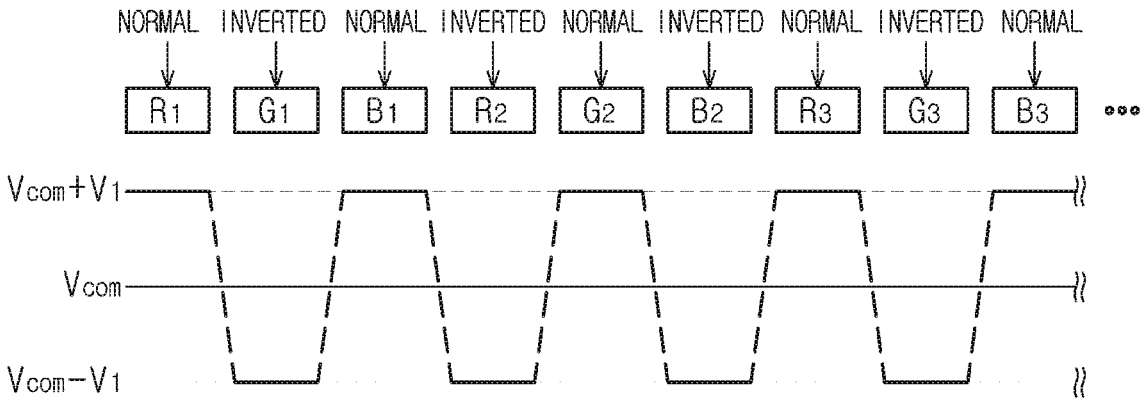
FIGS. 16A and 16B illustrates a voltage of a common electrode and a voltage of a pixel electrode for improving a viewing angle shown in FIG. 13.
Figure 17:
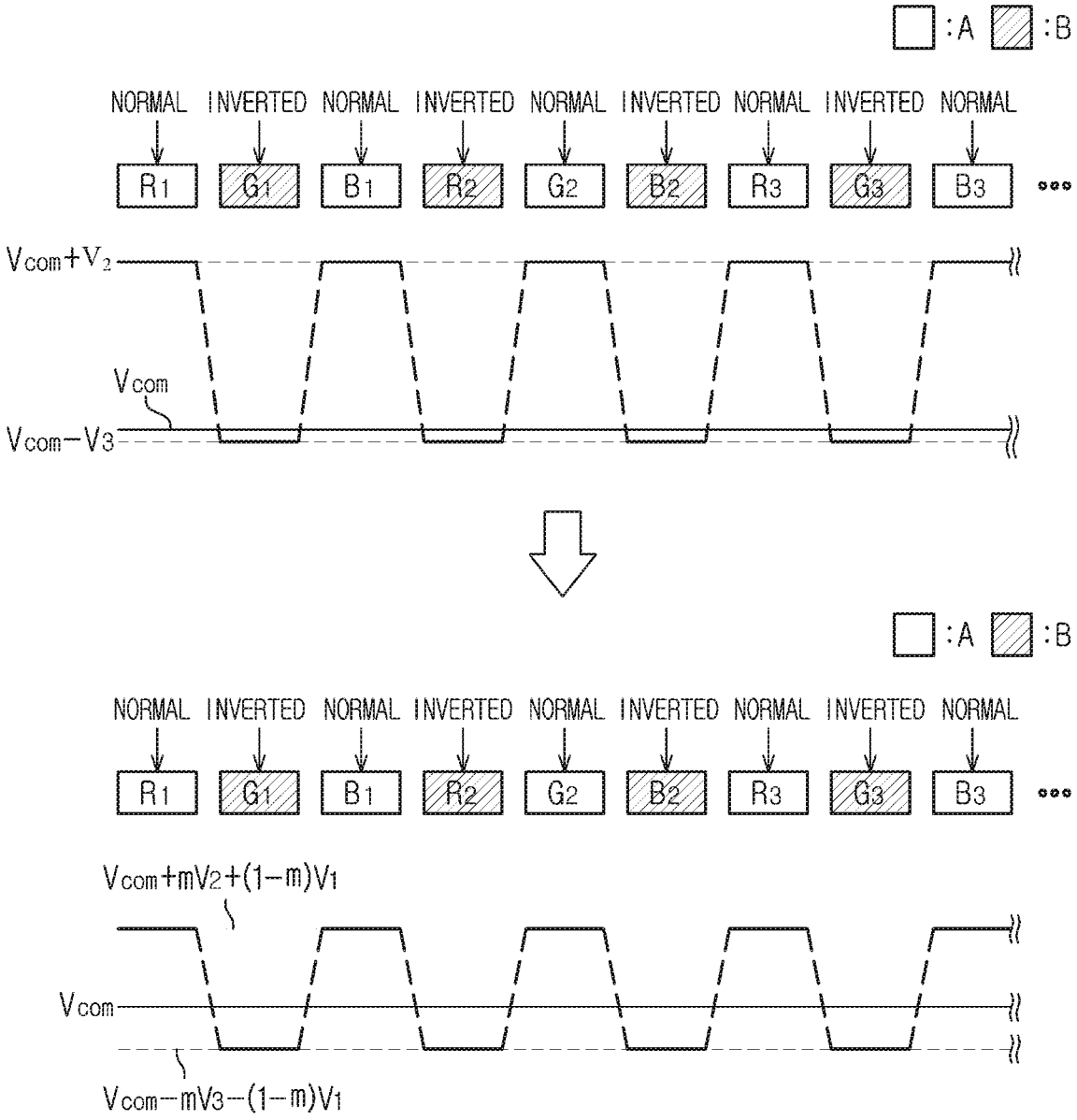
Figure 18:
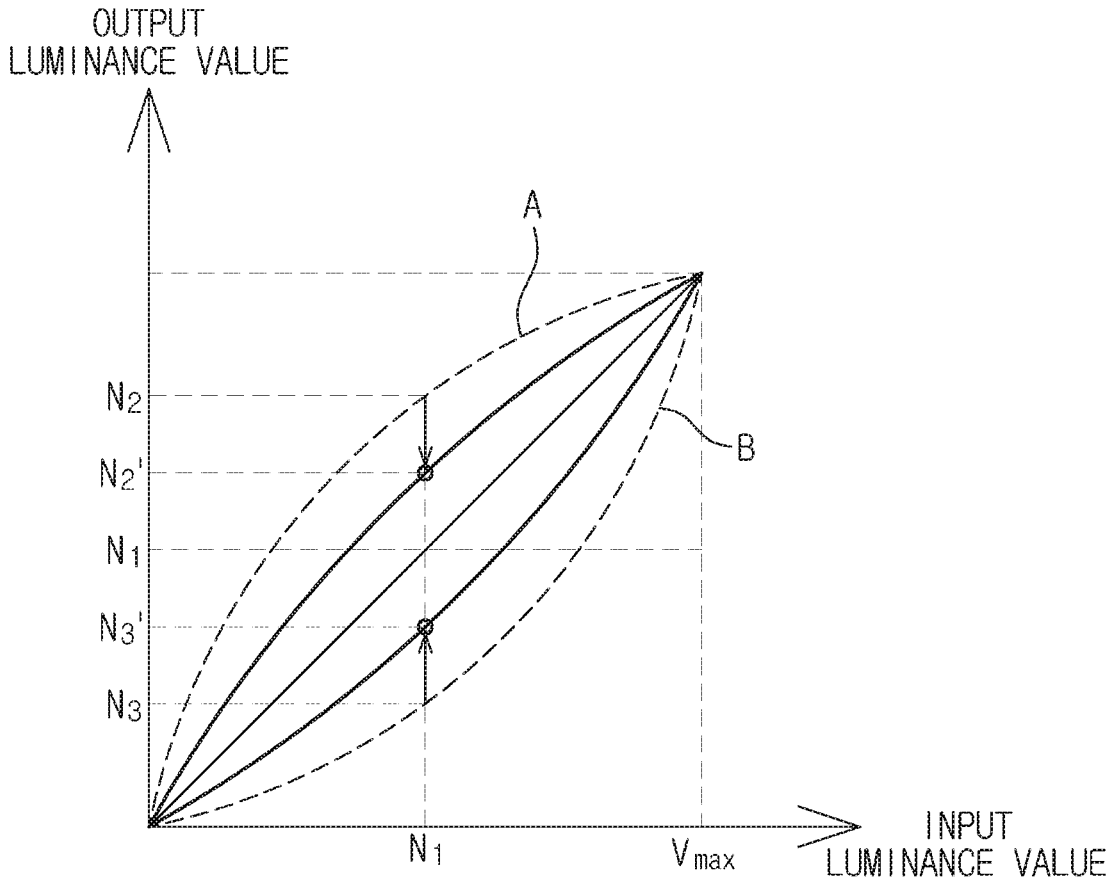
FIG. 18 illustrates a voltage of a common electrode and a voltage of a pixel electrode for reducing crosstalk shown in FIG. 13.

FIG. 13 is a view illustrating another example of a crosstalk reduction operation of a display apparatus according to an embodiment. FIG. 14 illustrates an example of a mapping graph for improving a viewing angle shown in FIG. 13. FIG. 15 illustrates an example of changing a luminance value of RGB image data according to a pixel position in order to improve a viewing angle shown in FIG. 13. FIG. 16 illustrates a voltage of a common electrode and a voltage of a pixel electrode for improving a viewing angle shown in FIG. 13. FIG. 17 illustrates a modification of a mapping graph for reducing crosstalk shown in FIG. 13. FIG. 18 illustrates a voltage of a common electrode and a voltage of a pixel electrode for reducing crosstalk shown in FIG. 13.

As shown in FIGS. 13, 14, 15, 16, 17 and 18, a crosstalk reduction operation 1100 of the display apparatus 1 is described.

The display apparatus 1 acquires RGB image data of the pixels P (1110).

The timing controller 210 may receive RGB image data from the controller 130. Specifically, receiving the RGB image data may be the same as in the operation 1010 illustrated in FIG. 8.

The display apparatus 1 changes the luminance value of the RGB image data in different ways according to the position of the pixels P (1120).

The timing controller 210 may change the luminance value of the RGB image data in a plurality of ways according to the position of the pixels P. For example, the timing controller 210 may change the luminance value of the RGB image data in different ways according to the position of the pixels P in order to improve (widen) the viewing angle of the display panel 300.

The timing controller 210 may use a plurality of change functions or a plurality of lookup tables to change the luminance values of the RGB image data.

For example, the timing controller 210 may change the luminance value of the RGB image data using graphs as shown in FIG. 14. The timing controller 210 may include a lookup table A (or function A) corresponding to graph A, and a lookup table B (or function B) corresponding to graph B.

The minimum luminance value '0' may be transformed into '0' by the lookup table A, and the maximum luminance value '255' may be transformed into '255' by the lookup table A. Further, a luminance value $N_1$ may be transformed into a luminance value $N_2$ by the lookup table A, and the luminance value $N_2$ is larger than the luminance value $N_1$. As a result, by the lookup table A, the luminance value of a pixel having medium brightness can be increased.

The minimum luminance value '0' may be transformed to '0' by the lookup table B, and the maximum luminance value '255' may be transformed to '255' by the lookup table B. Further, the luminance value $N_1$ may be transformed into a luminance value $N_3$ by the lookup table B, and the luminance value $N_3$ is smaller than the luminance value $N_1$. As a result, by the lookup table B, the luminance value of a pixel having intermediate brightness can be reduced.

Also, the average value of the luminance value $N_2$ output from the lookup table A and the luminance value $N_3$ output from the lookup table B may be the input luminance value $N_1$. In other words, the output of the lookup table A and the average value of the lookup table B may be original luminance values.

The timing controller 210 may change the luminance value of the RGB image data using either the lookup table A or the lookup table B according to the position of the sub-pixels $P_R$, $P_G$, and $P_B$, the position of the pixels P, or the row where the pixels P are located.

Figure 15A:
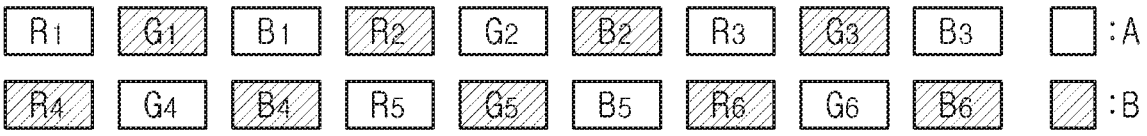
FIGS. 15A, 15B and 15C illustrates an example of changing a luminance value of RGB image data according to a pixel position in order to improve a viewing angle shown in FIG. 13.

As illustrated in FIG. 15A, the timing controller 210 uses the lookup table A and the lookup table B alternately according to the position of the sub-pixels $P_R$, $P_G$, and $P_B$ to change the luminance value of the RGB image data.

The timing controller 210 may change the luminance value of the RGB image data using the lookup table A for a first red sub-pixel $P_{R1}$ in a first row, change the luminance value of the RGB image data using the lookup table B for a first green sub-pixel $P_{G1}$, and change the luminance value of the RGB image data using the lookup table A for a first blue sub-pixel $P_{B1}$.

In addition, the timing controller 210 may change the luminance value of the RGB image data using the lookup table B for a fourth red sub-pixel $P_{R4}$ in a second row, change the luminance value of the RGB image data by using the lookup table A for a fourth green sub-pixel $P_{G4}$, and change the luminance value of the RGB image data by using the lookup table B for a fourth blue sub-pixel $P_{B4}$.

Figure 15B:
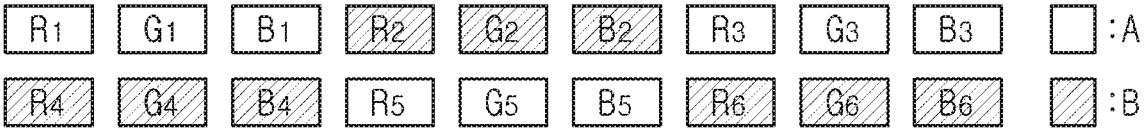

As illustrated in FIG. 15B, the timing controller 210 may change the luminance value of the RGB image data by alternately using the lookup table A and the lookup table B according to the position of the pixels P.

The timing controller 210 may change the luminance value of the RGB image data using the lookup table A for the first red/green/blue sub-pixels $P_{R1}$, $P_{G1}$, and $P_{B1}$ in the first row, change the luminance values of the RGB image data using the lookup table B for second red/green/blue sub-pixels $P_{R2}$, $P_{G2}$, and $P_{B2}$, and change the luminance values of the RGB image data using the lookup table A for third red/green/blue sub-pixels $P_{R3}$, $P_{G3}$, and $P_{B3}$.

In addition, the timing controller 210 may change the luminance value of the RGB image data using the lookup table B for the fourth red/green/blue sub-pixels $P_{R4}$, $P_{G4}$, and $P_{B4}$ in the second row, change the luminance value of the RGB image data using the lookup table A for fifth red/green/blue sub-pixels $P_{R5}$, $P_{G5}$, and $P_{B5}$, and change the luminance values of the RGB image data using the lookup table B for sixth red/green/blue sub-pixels $P_{R6}$, $P_{G6}$, and $P_{B6}$.

Figure 15C:
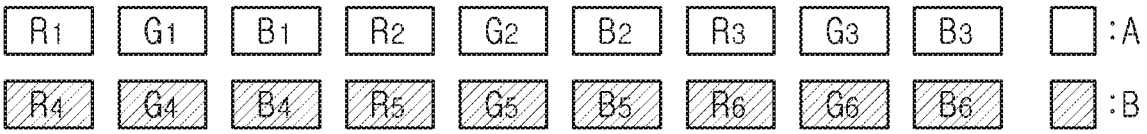

As illustrated in FIG. 15C, the timing controller 210 may change the luminance value of the RGB image data by alternately using the lookup table A and the lookup table B according to the row in which the pixels P are located.

The timing controller 210 may change the luminance values of the RGB image data for the first red/green/blue sub-pixels $P_{R1}$, $P_{G1}$, and $P_{B1}$, the second red/green/blue sub-pixels $P_{R2}$, $P_{G2}$, and $P_{B2}$, and the third red/green/blue sub pixels $P_{R3}$, $P_{G3}$, and $P_{B3}$ in the first row using the lookup table A.

The timing controller 210 may change the luminance values of the RGB image data for the fourth red/green/blue sub-pixels $P_{R4}$, $P_{G4}$, and $P_{B4}$ in the second row, the fifth red/green/blue sub-pixels $P_{R5}$, $P_{G5}$, and $P_{B5}$, and the sixth red/green/blue sub pixels $P_{R6}$, $P_{G6}$, and $P_{B6}$ in the second row using the lookup table B.

As such, the viewing angle of the display panel 300 may be extended by changing the luminance value of the RGB image data. The viewing angle of the image is extended by changing the luminance value of the RGB image data using the graph A or the graph B shown in FIG. 14. In addition, by alternately using the graphs A and B, the average value of the luminance values may be kept constant and the image may not be changed.

Therefore, the viewing angle of the image may be expanded and the change of the image may be minimized by the operation 1120.

Thereafter, the display apparatus 1 determines the voltage value of the RGB image signal from the RGB image data (1130).

The timing controller 210 may include a lookup table corresponding to a graph representing a relationship between the luminance value of the RGB image data and the voltage value of the RGB image signal, as shown in FIG. 9B. The timing controller 210 may determine the voltage value of the RGB image signal corresponding to the luminance value of the RGB image data using the lookup table.

Since the luminance value of the RGB image data is changed by the operation 1120, the voltage value of the RGB image signal corresponding to the RGB image data is also changed, and the voltage value of the normal/inverted voltage signal by the RGB video signal is also changed.

Figure 16B:
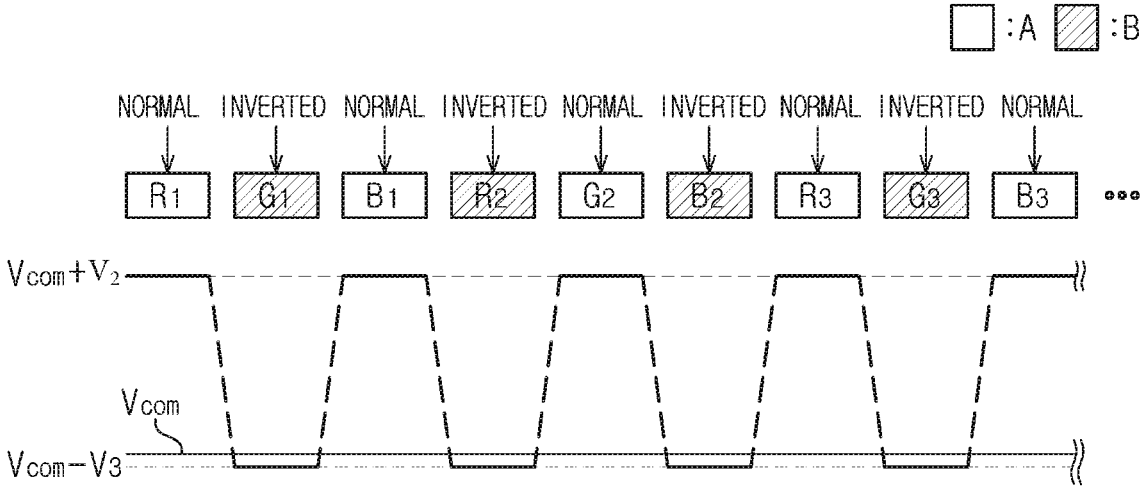

For example, the luminance value $N_1$ of the RGB image data may be converted to the first voltage value $V_1$ of the RGB image signal as shown in FIG. 16B.

In addition, the voltage $V_{COM}+V_1$ of the normal voltage signal is applied to the first red sub-pixel $P_{R1}$ by the voltage value $V_1$ of the RGB image signal, the voltage $V_{COM}-V_1$ of the inverted voltage signal is applied to the first green sub-pixel $P_{G1}$, and the voltage $V_{COM}+V_1$ of the normal voltage signal may be applied to the first blue sub-pixel $P_{B1}$.

In the operation 1120, the luminance value $N_1$ of the RGB image data is changed to the luminance value $N_2$ or the luminance value $N_3$ according to the position of the sub-pixels $P_R$, $P_G$, and $P_B$. The luminance value $N_2$ and the luminance value $N_3$ of the RGB image data are changed to the second and third voltage values $V_2$ and $V_3$ of the RGB image signals, respectively, as shown in FIG. 16B. The second voltage value $V_2$ of the RGB image signal may be greater than the third voltage value $V_3$.

In addition, by the voltage value $V_2$ or the voltage value $V_3$ of the RGB video signal, the voltage $V_{COM}+V_2$ of the normal voltage signal is applied to the first red sub-pixel $P_{R1}$, the voltage $V_{COM}-V_3$ of the inverted voltage signal is applied to the first green sub-pixel $P_{G1}$, and the voltage $V_{COM}+V_2$ of the normal voltage signal may be applied to the first blue sub-pixel $P_{B1}$.

The normal/inverted voltage signal by the modified RGB image data is similar to the voltage of the normal/inverted voltage signal in the second region $R_2$ of the image $I_1$ shown in FIG. 6. According to FIG. 16B, the voltage values $V_2$ and $V_3$ of the RGB image signal are alternately repeated for each of the sub-pixels $P_R$, $P_G$, and $P_B$. In addition, the normal voltage signal and the inverted voltage signal are alternately repeated for each of the sub-pixels $P_R$, $P_G$, and $P_B$. As a result, the normal voltage signal of the voltage $V_{COM}+V_2$ and the inverted voltage signal of the voltage $V_{COM}-V_3$ are alternately repeated.

As a result, the average value of the normal/inverted voltage signal due to the changed RGB image data is expected to be different from the common voltage $V_{COM}$. In other words, the voltage of the common electrode 26 may be different from the common voltage $V_{COM}$.

The display apparatus 1 corrects the RGB image data to match the voltage of the common electrode 26 and the common voltage $V_{COM}$ (1140).

To match the voltage of the common electrode 26 and the common voltage $V_{COM}$, the timing controller 210 may adjust the RGB image data changed in the operation 1120.

Specifically, in order to match the voltage of the common electrode 26 and the common voltage $V_{COM}$, the timing controller 210 may apply a weight m to the voltage value of the RGB image signal based on the RGB image data changed in the operation 1120, and a weight 1−m can be applied to the voltage value of the RGB image signal based on the original RGB image data.

In addition, when the sum of the voltage values of the RGB image signal corresponding to the normal voltage signal and the sum of the voltage values of the RGB image signal corresponding to the inverted voltage signal are the same, the timing controller 210 may determine the weight m of the changed RGB image data by using the voltage of the common electrode 26 coinciding with the common voltage $V_{COM}$.

For example, if the voltage of the common electrode 26 coincides with the common voltage $V_{COM}$, the voltage value of the RGB image signal for the first red sub-pixel $P_{R1}$, the voltage value of the RGB image signal for the first blue sub-pixel $P_{B1}$ and the voltage value of the RGB image signal for the second red sub-pixel $P_{R2}$ may be equal to the sum of the voltage value of the RGB image signal for the first green sub-pixel $P_{G1}$, the voltage value of the RGB image signal for the second red sub-pixel $P_{R2}$ and the voltage value of the RGB image signal for the second blue sub-pixel $P_{B2}$. In other words, when the voltage of the common electrode 26 and the common voltage $V_{COM}$ match, [Equation 1] may be applied.

$$m(V_{R1}^{M}+V_{B1}^{M}+V_{G2}^{M})+(1-m)(V_{R1}^{O}+V_{B1}^{O}+V_{G2}^{O})=m(V_{G1}^{M}+V_{R2}^{M}+V_{B2}^{M})+(1-m)(V_{G1}^{O}+V_{R2}^{O}+V_{B2}^{O}) \quad \text{[Equation 1]}$$

Here, m refers to the weight of the changed RGB image data, $V_{R1}^{O}$ and $V_{G1}^{O}$ and $V_{B1}^{O}$ represent voltage values of the original RGB image signal for the first red/green/blue sub-pixels, respectively, $V_{R2}^{O}$ and $V_{G2}^{O}$ and $V_{B2}^{O}$ represent the voltage value of the original RGB image signal for the second red/green/blue sub-pixels, $V_{R1}^{M}$ and $V_{G1}^{M}$ and $V_{B1}^{M}$ represent voltage values of the modified RGB image signal for the first red/green/blue sub-pixels, and $V_{R2}^{M}$ and $V_{G2}^{M}$ and $V_{B2}^{M}$ represent the voltage values of the modified RGB image signal for the second red/green/blue sub-pixels.

When [Equation 2] is binomial with respect to m, [Equation 2] is obtained.

$$m = \frac{-[(V_{R1,B1,G2}^{O})-(V_{R1,B1,G2}^{O})]}{[(V_{R1,B1,G2}^{M})-(V_{G1,R2,B2}^{M})]-[(V_{R1,B1,G2}^{O})-(V_{R1,B1,G2}^{O})]} \quad \text{[Equation 2]}$$

$$V_{R1,B1,G2}^{M} = V_{R1}^{M} + V_{B1}^{M} + V_{G2}^{M}$$

$$V_{G1,R2,B2}^{M} = V_{G1}^{M} + V_{R2}^{M} + V_{B2}^{M}$$

$$V_{R1,B1,G2}^{O} = V_{R1}^{O} + V_{B1}^{O} + V_{G2}^{O}$$

$$V_{G1,R2,B2}^{O} = V_{G1}^{O} + V_{R2}^{O} + V_{B2}^{O}$$

Here, m refers to the weight of the changed RGB image data, $V_{R1}^{O}$ and $V_{G1}^{O}$ and $V_{B1}^{O}$ represent voltage values of the original RGB image signal for the first red/green/blue sub-pixels, respectively, $V_{R2}^{O}$ and $V_{G2}^{O}$ and $V_{B2}^{O}$ represent voltage values of the original RGB image signal for the second red/green/blue sub-pixels, $V_{R1}^{M}$ and $V_{G1}^{M}$ and $V_{B1}^{M}$ represent voltage values of the modified RGB image signal for the first red/green/blue sub-pixels, and $V_{R2}^{M}$ and $V_{G2}^{M}$ and $V_{B2}^{M}$ represent voltage values of the modified RGB image signal for the second red/green/blue sub-pixels.

The timing controller 210 may determine the weight m of the changed RGB image data and the weight 1−m of the original RGB image data using [Equation 2].

When the weight m is applied to the voltage value of the changed RGB video signal, and the weight 1−m is applied to the voltage value of the original RGB video signal, the normal/inverted voltage signal applied to each of the pixels P may be changed.

For example, as shown in FIG. 17, by the voltage value $V_2$ or the voltage value $V_3$ of the RGB image signal changed by the operation 1120, the voltage $V_{COM}+V_2$ of the normal voltage signal is applied to the first red sub-pixel $P_{R1}$, the voltage $V_{COM}-V_3$ of the inverted voltage signal is applied to the first green sub-pixel $P_{G1}$, and the voltage $V_{COM}+V_2$ of the normal voltage signal may be applied to the first blue sub-pixel $P_{B1}$.

When the weight m value is applied to the voltage value of the changed RGB image signal and the weight 1−m value is applied to the voltage value of the original RGB image signal, the voltage value of the RGB image signal may be changed to $mV_2+(1-m)V_1$ and the voltage value of the RGB image signal to $mV_3+(1-m)V_1$. In addition, the voltage $V_{COM}+mV_2+(1-m)V_1$ of the normal voltage signal is applied to the first red sub-pixel $P_{R1}$, the voltage $V_{COM}-mV_3-(1-m)V_1$ of the inverted voltage signal is applied to the first green sub-pixel $P_{G1}$, and the voltage $V_{COM}+mV_2+(1-m)V_1$ of the normal voltage signal may be applied to the first blue sub-pixel $P_{B1}$. Also, the average value of the normal voltage signals and the inverted voltage signals applied to the pixels P may be approximately equal to the common voltage $V_{COM}$.

By applying the weights m and 1−m to the luminance values of the changed RGB image data and the luminance values of the original RGB image data, respectively, the adjusted RGB image data may be generated to reduce image crosstalk.

For example, applying the weights m and 1−m to the luminance values of the changed RGB image data and the luminance values of the original RGB image data, respectively, the luminance value of the RGB image data can be changed as shown in FIG. 18.

The luminance value $N_1$ can be adjusted to a luminance value $N_2'$ by the lookup table A and the weights m and 1−m, and a luminance value $N_3'$ may be adjusted by the lookup table B and the weights m and 1−m.

The luminance value $N_2'$ and the luminance value $N_3'$ may be the same as in [Equation 3] and [Equation 4], respectively.

$$N_2'=N_1+m(N_2-N_1) \quad \text{[Equation 3]}$$

However, $N_1$ represents the luminance value of the original RGB image data, $N_2$ represents the luminance value of the RGB image data changed by the lookup table A, and $N_2'$ may represent the luminance value of the RGB image data changed by the lookup table A and the weights m and 1−m.

$$N_3'=N_1-m(N_3-N_1) \quad \text{[Equation 4]}$$

However, $N_1$ represents the luminance value of the original RGB image data, $N_3$ represents the luminance value of the RGB image data changed by the lookup table B, and $N_3'$ may represent the luminance value of the RGB image data changed by the lookup table B and the weights m and 1−m.

In this way, the timing controller 210 determines the weight m of the RGB image data changed in the operation 1120 and the weight 1−m of the original RGB image data in order to match the voltage of the common electrode 26 and the common voltage $V_{COM}$ and by applying the weight m to the luminance value of the RGB image data changed in the operation 1120 and applying the weight 1−m to the luminance value of the original RGB image data, the adjusted RGB image data may be generated to reduce image crosstalk.

Thereafter, the display apparatus 1 displays an image corresponding to the corrected RGB image data (1150).

The timing controller 210 outputs the adjusted RGB image data with the source control signal to the source driver 230, and outputs the gate control signal to the gate driver 240. An image corresponding to the corrected RGB image data may be displayed on the display panel 300 by the operation of the source driver 230 and the gate driver 240.

As described above, the timing controller 210 changes the RGB image data to expand the viewing angle, and adjustes the RGB image data to match the voltage of the common electrode 26 and the common voltage $V_{COM}$. Accordingly, the viewing angle may be expanded and crosstalk of the image may be eliminated by the adjusted the RGB image data.

In the above, the viewing angle is expanded and the crosstalk of the image is reduced by the timing controller 210, but the present invention is not limited thereto.

The controller 130 may adjust the RGB image data in order to expand the viewing angle of the display panel 300 and reduce the difference between the voltage of the common electrode 26 and the common voltage $V_{COM}$.

For example, the controller 130 may decode the video signal received by the content receiver 120 and may generate RGB image data for playing the image from the video signal (1110). The controller 130 changes the luminance value of the RGB image data in different ways according to the position of the pixels P to expand the viewing angle (1120), determines the voltage value of the RGB image signal from the RGB image data (1130), and adjusts the RGB image data to match the voltage of the common electrode 26 and the common voltage $V_{COM}$ (1140). Thereafter, the controller 130 may output the adjusted RGB image data to the timing controller 210. The timing controller 210 outputs the adjusted RGB image data to the source driver 230 together with the source control signal, and the gate control signal may be output to the gate driver 240 (1150).

As described above, the display apparatus 1 may expand a viewing angle and reduce crosstalk of an image by an image processing operation of the timing controller 210 or the controller 130 without additional hardware. In other words, the RGB image data is corrected by the operation of the timing controller 210 or the controller 130, the viewing angle of the display panel 300 is expanded, and crosstalk of the image can be reduced.

Figure 19:
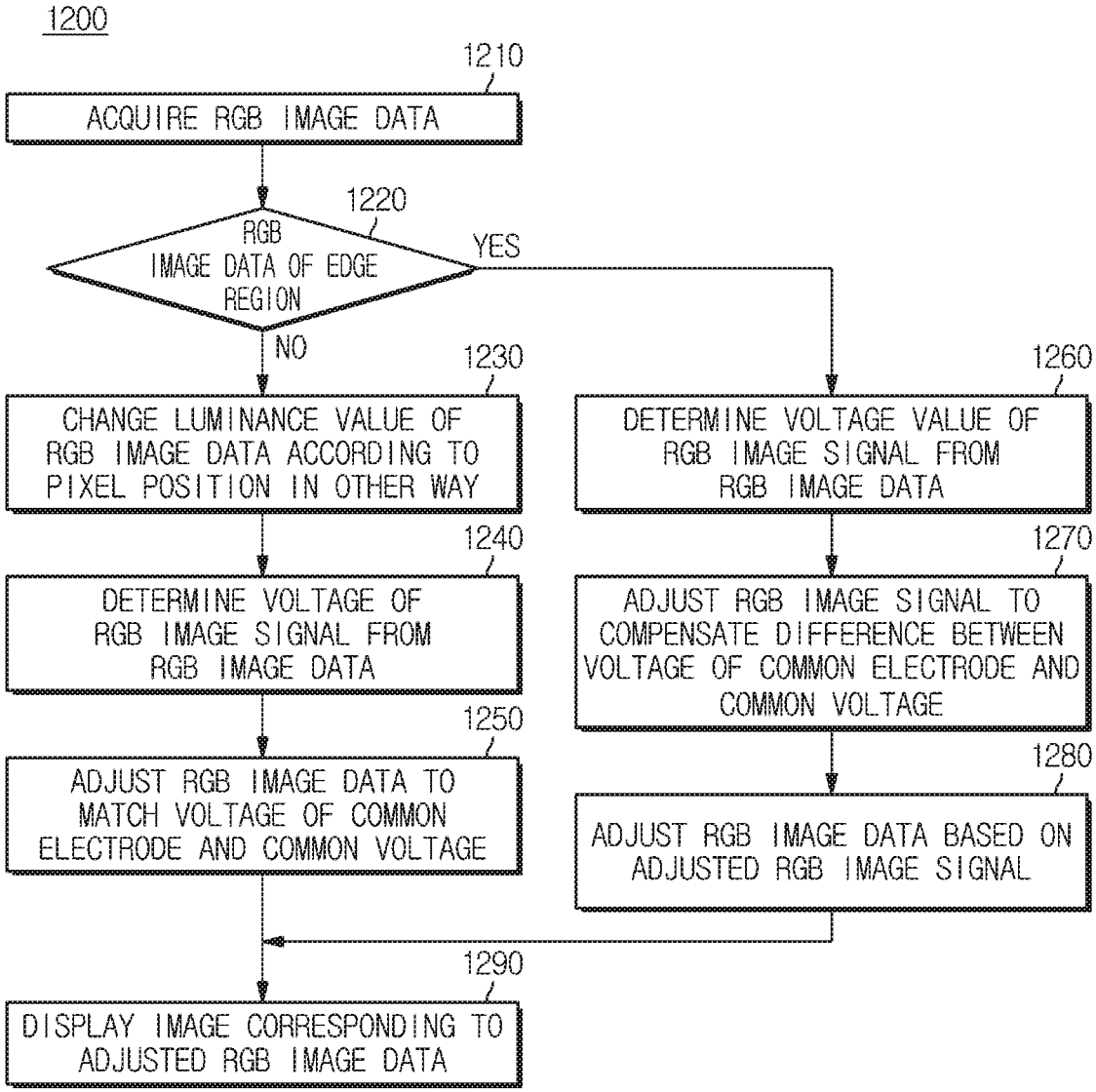
FIG. 19 illustrates another example of a crosstalk reduction operation of a display apparatus according to an embodiment.

FIG. 19 illustrates another example of a crosstalk reduction operation of a display apparatus according to an embodiment.

As shown in FIG. 19, a crosstalk reduction operation 1200 of the display apparatus 1 will be described.

The display apparatus 1 acquires RGB image data of the pixels P (1210).

The timing controller 210 receiving the RGB image data may be the same as in the operation 1010 illustrated in FIG. 8 and the operation 1110 illustrated in FIG. 13.

The display apparatus 1 determines whether the obtained RGB image data is the RGB image data in an edge region (1220).

The edge region may represent an area in which the brightness or color of the image changes rapidly. In other words, the red luminance value, the green luminance value, and the blue luminance value of the RGB image data in the edge region may rapidly change.

The timing controller 210 may determine whether the RGB image data is in the edge region based on the amount of change of the red luminance value, the green luminance value, and the blue luminance value of the RGB image data.

For example, when at least one of a change amount of the red luminance value, a change amount of the green luminance value, and a change amount of the blue luminance value is greater than a reference change amount, the timing controller 210 may determine that the acquired RGB image data is the RGB image data in the edge region. In addition, when both the change amount of the red luminance value, the change amount of the green luminance value, and the change amount of the blue luminance value are smaller than the reference change amount, the timing controller 210 may determine that the acquired RGB image data is not the RGB image data in the edge region.

When it is determined that the acquired RGB image data is not the RGB image data in the edge region (NO in 1220), the display apparatus 1 changes the luminance value of the RGB image data in different ways according to the position of the pixels P (1230), determines the voltage value of the RGB image signal from the RGB image data (1240), and adjusts the RGB image data to match the voltage of the common electrode 26 and the common voltage $V_{COM}$ (1250).

When the acquired RGB image data is not the RGB image data in the edge region, the timing controller 210 expands the viewing angle of the display apparatus 1 and adjusts the RGB image data to prevent crosstalk of an image displayed on the display apparatus 1.

The operations 1230, 1240, and 1250 may be the same as the operations 1120, 1130, and 1140 shown in FIG. 13.

When it is determined that the acquired RGB image data is the RGB image data of the edge region (YES in 1220), the display apparatus 1 determines the voltage value of the RGB image signal from the RGB image data (1260), and adjusts the RGB image signal to compensate for the difference between the voltage of the common voltage $V_{COM}$ and the common voltage (1270), and adjusts the RGB image data based on the corrected RGB image signal (1280).

When the acquired RGB image data is the RGB image data in the edge region, the timing controller 210 may not change the RGB image data for extending the viewing angle to prevent image distortion. In addition, the timing controller 210 may correct the RGB image data to prevent crosstalk of the image.

The operations 1260, 1270, and 1280 may be the same as the operations 1020, 1030, and 1040 shown in FIG. 8.

Thereafter, the display apparatus 1 displays an image corresponding to the corrected RGB image data (1250).

The timing controller 210 outputs the adjusted RGB image data to the source driver 230 together with the source control signal, and outputs the gate control signal to the gate driver 240. An image corresponding to the corrected RGB image data may be displayed on the display panel 300 by the operation of the source driver 230 and the gate driver 240.

As described above, the display apparatus 1 can change the RGB image data to expand the viewing angle according to the characteristics of the image, and the RGB image data may be corrected to correct a difference between the voltage of the common electrode 26 and the common voltage $V_{COM}$. Accordingly, the viewing angle may be extended and crosstalk of the image may be eliminated by correcting the RGB image data without distortion of the image.

Meanwhile, the disclosed embodiments may be implemented in the form of a recording medium that stores instructions executable by a computer. The instructions may be stored in the form of a program code, and when executed by a processor, may generate program modules to perform operations of the disclosed embodiments. The recording medium may be embodied as a computer-readable recording medium.

The computer-readable recording medium includes all kinds of recording media storing instructions that can be read by a computer. For example, there may be read only memory (ROM), random access memory (RAM), a magnetic tape, a magnetic disk, flash memory, and an optical data storage device.

As described above, the disclosed embodiments have been described with reference to the accompanying drawings. Those of ordinary skill in the art to which the posted embodiments belong will understand that they may be practiced in different forms from the disclosed embodiments without changing the technical spirit or essential features of the posted embodiments. The disclosed embodiments are illustrative and should not be construed as limiting.

The invention claimed is:

1. A display apparatus, comprising:

a display panel including a plurality of pixels;

a source driver configured to convert RGB image data into an RGB image signal, and output the RGB image signal based on a common voltage to each of the plurality of pixels; and a timing controller configured to output the RGB image data to the source driver, wherein, when it is determined the common voltage is changed, the timing controller is configured to adjust the RGB image data to compensate the change of the common voltage, and output the adjusted RGB image data to the source driver, wherein the timing controller is configured to change the RGB image data into any one of first RGB image data or second RGB image data according to positions of the plurality of pixels, using a first lookup table and a second lookup table, and the source driver is configured to output any one of a normal RGB image signal or an inverted RGB image signal based on the common voltage, according to the positions of the plurality of pixels.

2. The display apparatus of claim 1, wherein the timing controller is configured to determine the RGB image signal from the RGB image data, determine a change amount of the common voltage, change the RGB image signal according to the change amount of the common voltage, and output the RGB image data corresponding to the changed RGB image signal to the source driver.

3. The display apparatus of claim 2, wherein the timing controller is configured to change the RGB image signal larger than a reference voltage according to the change amount of the common voltage.

4. The display apparatus of claim 1, wherein the timing controller is configured to alternately change the RGB image data to the first RGB image data and the second RGB image data, by alternately using the first lookup table and the second lookup table according to the positions of the plurality of pixels, and wherein the source driver is configured to alternately output the normal RGB image signal and the inverted RGB image signal according to the positions of the plurality of pixels.

5. The display apparatus of claim 1, wherein the timing controller is configured to synthesize the RGB image data and any one of the first and second RGB image data, and output the synthesized image data to the source driver.

6. The display apparatus of claim 1, wherein the timing controller is configured to add any one of the first and second RGB image data to which a first weight is applied and the RGB image data to which a second weight is applied, and output the added RGB image data to the source driver.

7. The display apparatus of claim 1, wherein the timing controller is configured to:

determine a normal voltage value of the RGB image signal from the RGB image data;

determine an inverted voltage value of the RGB image signal from the RGB image data;

determine a voltage value of the normal RGB image signal from any one of the first RGB image data and the second RGB image data;

determine a voltage value of the inverted RGB image signal from any one of the first RGB image data and the second RGB image data; and set a first and second weight so that a sum of the voltage value of the normal RGB image signal to which the first weight is applied and the voltage value of the normal RGB image signal to which the second weight is applied is equal to a sum of the voltage value of the inverted RGB image signal to which the first weight is applied and the voltage value of the inverted RGB image signal to which the second weight is applied.

8. A control method of a display apparatus including a plurality of pixels, the method comprising:

acquiring RGB image data;

converting the RGB image data into an RGB image signal; and outputting the RGB image signal based on a common voltage to each of the plurality of pixels; wherein when it is determined the common voltage is changed, adjusting the RGB image data to compensate the change of the common voltage, and wherein the method further comprises:

changing the RGB image data into any one of first RGB image data or second RGB image data according to positions of the plurality of pixels using a first lookup table and a second lookup table; and outputting any one of a normal RGB image signal or an inverted RGB image signal based on the common voltage according to the positions of the plurality of pixels.

9. The method of claim 8, wherein the changing the RGB image data into any one of the first RGB image data or the second RGB image data includes alternately changing the RGB image data to the first RGB image data and the second RGB image data by alternately using the first lookup table and the second lookup table according to the positions of the plurality of pixels, and the outputting any one of the normal RGB image signal or the inverted RGB image signal includes alternately outputting the normal RGB image signal and the inverted RGB image signal according to the positions of the plurality of pixels.

10. The method of claim 8, wherein the adjusting the RGB image data to compensate the change of the common voltage includes synthesizing the RGB image data and any one of the first and second RGB image data.

11. The method of claim 8, further comprising:

synthesizing the RGB image data and any one of the first and second RGB image data and adding any one of the first and second RGB image data to which a first weight is applied and the RGB image data to which a second weight is applied.

12. The method of claim 8 further comprising:

determining a normal voltage value of the RGB image signal from the RGB image data;

determining an inverted voltage value of the RGB image signal from the RGB image data;

determining a voltage value of the normal RGB image signal from any one of the first RGB image data and the second RGB image data;

determining a voltage value of the inverted RGB image signal from any one of the first RGB image data and the second RGB image data; and setting a first and second weight so that a sum of the voltage value of the normal RGB image signal to which the first weight is applied and the voltage value of the normal RGB image signal to which the second weight is applied is equal to a sum of the voltage value of the inverted RGB image signal to which the first weight is applied and the voltage value of the inverted RGB image signal to which the second weight is applied.

13. The method of claim 8, wherein the adjusting the RGB image data to compensate the change of the common voltage includes:

determining the RGB image signal from the RGB image data, determining a change amount of the common voltage, changing the RGB image signal according to the change amount of the common voltage, and adjusting the RGB image data based on the changed RGB image signal.

* * * * *